United States Patent [19]

Suzuki et al.

[11] Patent Number: 4,781,096

[45] Date of Patent: Nov. 1, 1988

[54] MUSICAL TONE GENERATING APPARATUS

[75] Inventors: Hideo Suzuki; Toshifumi Kunimoto, both of Hamamatsu, Japan

[73] Assignee: Nippon Gakki Seizo Kabushiki Kaisha, Hamamatsu, Japan

[21] Appl. No.: 784,842

[22] Filed: Oct. 4, 1985

[30] Foreign Application Priority Data

| | | | |
|---|---|---|---|
| Oct. 9, 1984 | [JP] | Japan | 59-212381 |
| Oct. 9, 1984 | [JP] | Japan | 59-212382 |
| Oct. 9, 1984 | [JP] | Japan | 59-212383 |
| Dec. 20, 1984 | [JP] | Japan | 59-269374 |
| Dec. 20, 1984 | [JP] | Japan | 59-269375 |

[51] Int. Cl.[4] ..... G10H 1/06; G10H 7/00

[52] U.S. Cl. ..... 84/1.01; 84/1.22; 84/1.28; 364/723

[58] Field of Search ..... 84/1.01, 1.03, 1.28, 84/1.22; 364/723; 381/30, 35, 36

[56] References Cited

U.S. PATENT DOCUMENTS

| | | | |
|---|---|---|---|
| 4,133,241 | 1/1979 | Niimi et al. . | |
| 4,137,810 | 2/1979 | Wheelwright et al. | 84/1.22 |
| 4,435,831 | 3/1984 | Mozer | 381/35 |
| 4,484,507 | 11/1984 | Nakaja et al. | 84/1.03 |
| 4,536,853 | 8/1985 | Kawamoto | 84/1.01 |
| 4,611,522 | 9/1986 | Suzuki | 84/1.01 |
| 4,641,564 | 2/1987 | Okamoto | 84/1.19 |

OTHER PUBLICATIONS

"Musical Sound Synthesis by Forward Differences" by Yasuhiro Mitsuhashi, 8013 *Journal of the Audio Engineering Society,* vol. 30(1982) Jan.-Feb., No. ½, New York, U.S.A.

*Primary Examiner*—S. J. Witkowski

*Attorney, Agent, or Firm*—Spensley Horn Jubas & Lubitz

[57] ABSTRACT

A musical tone generating apparatus for an electronic musical instrument utilizing a data compression system is disclosed. This musical tone generating apparatus is basically constructed by a memory storing difference data and a data reproduction circuit. The difference data is in advance obtained by converting a musical tone signal to be reproduced to digital sample data, effecting a linear prediction operation on the digital sample data to produce prediction data and calculating the difference between the digital sample data and the prediction data. The stored difference data are sequentially read from the memory. In the data reproduction circuit, the musical tone signal is reproduced by effecting a reverse operation of the linear prediction operation on the read difference data. In the case where the musical tone signal is a periodic signal, the efficiency of the data compression is further enhanced by subtracting from each difference data to be stored in the memory that difference data which was generated one period of the musical tone signal before the generation of the each difference data. The efficiency of the data compression is more further enhanced by subtracting from each difference data that difference data which was generated a predetermined number of sampling intervals before the generation of the each difference data.

20 Claims, 17 Drawing Sheets

MUSICAL TONE GENERATING APPARATUS

BACKGROUND OF THE INVENTION

1. Field of the Invention

This invention generally relates to a musical tone generating apparatus for use, for example, in an electronic musical instrument, and more particularly to such a tone generating apparatus in which a data compression method based on the linear predictive coding is used to reduce the amount of data of tone signals.

2. Prior Art

There have been proposed various kinds of signal processing methods in which an analog signal is first converted into sampled digital data to allow the analog signal to be digitally processed. Such methods are widely used particularly in tone generating apparatuses provided in, for example, voice synthesizers, electronic musical instruments and data communication systems.

Among such signal processing methods, a PCM (Pulse Code Modulation) method such as one disclosed in U.S. Pat. No. 4,383,462 is known. In this PCM method, an overall waveform of an analog signal such as a tone signal is sampled at a predetermined rate and the thus obtained series of sampled digital data are stored in a memory. And, the stored data are sequentially read from the memory and converted into analog signals to reproduce the analog signal. The PCM method is advantageous in that an exact reproduction of signal can be achieved and is therefore suitable for use in an electronic musical instrument, but has such a deficiency that the amount of data to be stored in the memory is large.

To overcome the deficiency of the PCM method, various methods of reducing the amount of data, such as a DM (Delta Modulation) method, a DPCM (Differential Pulse Code Modulation) method and an ADPCM (Adaptive Differential Pulse Code Modulation) method, have been proposed. Even by these methods, however, the amount of data can not sufficiently be reduced to such an extent that an electronic musical instrument can employ these methods to generate various musical tone signals. Also, in these methods, each data to be presently stored is formed based only on the precedingly obtained sample data and therefore includes unavoidable errors so that an exact reproduction of signal can not be achieved.

SUMMARY OF THE INVENTION

It is therefore an object of the invention to provide a tone generating apparatus in which the amount of data of a tone signal can be efficiently reduced.

It is another object of the invention to provide such a tone generating apparatus in which an exact reproduction of a tone signal can be achieved.

It is a further object of the invention to provide such a tone generating apparatus in which the amount of data of a periodic tone signal such as a tone signal generated by a nonelectronic musical instrument can be stored and reproduced with a memory of a less capacity.

It is a still further object of the invention to provide a tone generating apparatus which is suitable for use in an electronic musical instrument such as a keyboard musical instrument.

According to one aspect of the present invention, there is provided a musical tone generating apparatus for an electronic musical instrument comprising memory means for storing a series of difference data each representing a difference between a corresponding one of a series of sample data of a musical tone signal and prediction data of the corresponding one of the series of sample data, the prediction data being produced by effecting a first linear operation on those of the series of sample data which have a predetermined relation of time to the corresponding one of the series of sample data; and data reproducing means responsive to each difference data outputted from the memory means for reproducing a corresponding one of the sample data, the data reproducing means adding the each of the outputted difference data to data obtained by effecting a second linear operation corresponding to the first linear operation on those reproduced sample data which have the predetermined relation of time to the each outputted difference data.

In the case where the musical tone signal is a periodic signal, the memory means may alternatively store a series of second difference data each representing a difference between a corresponding one of the series of difference data and that of the series of difference data produced at a time interval corresponding to a period of the tone signal before the corresponding one of the series of difference data. In this case, the musical tone generating apparatus further comprises second data reproducing means which comprises first delay circuit means for delaying data inputted thereto by the time interval to output delayed data, and first adder means for adding the each second difference data outputted from the memory means to the delayed data, each addition result being supplied to the first delay circuit means as the data and to the data reproducing means as the outputted difference data.

The memory means may alternatively store a series of third difference data each representing a difference between a corresponding one of the series of second difference data and that of the series of second difference data produced a second time interval corresponding to a predetermined number of sampling intervals of the tone signal before the corresponding one of the series of second difference data. In this case, the musical tone generating apparatus further comprises third data reproducing means comprising second delay circuit means for delaying data inputted thereto by the second time interval to output delayed data, and second adder means for adding each of the third difference data outputted from the memory means to the delayed data outputted from the second delay circuit means, each addition result being supplied to the second delay circuit means as the data and to the first adder means as the outputted second difference data.

According to another aspect of the present invention, there is provided a musical tone data compression apparatus for a musical tone generating apparatus of an electronic musical instrument comprising sampling means for sampling plural amplitude values at plural positions on time axis from a musical tone signal to be produced; and prediction means for calculating other amplitude values at the plural points by effecting a linear operation on the amplitude values, each of the other amplitude values being determined on the basis of one or ones at point or points before and after the point corresponding to the each amplitude value among the plural amplitude values.

DESCRIPTION OF THE PREFERRED EMBODIMENTS OF THE INVENTION

Figure 1:
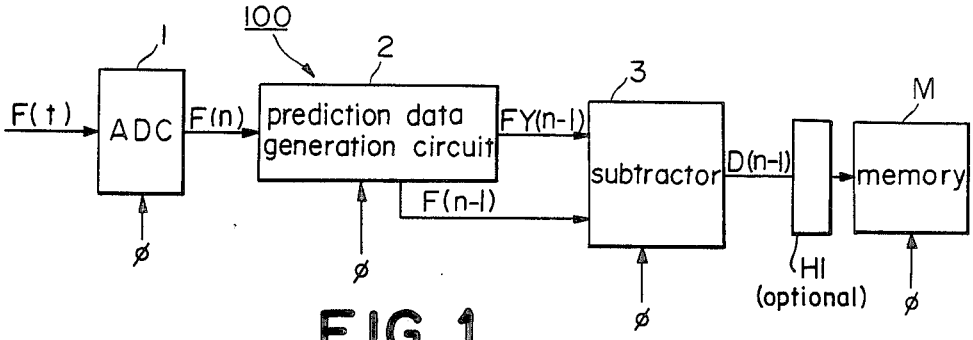
FIG. 1 is a block diagram of a data write section of a musical tone generating apparatus according to a first embodiment of the invention.

A musical tone generating apparatus provided in accordance with the present invention will now be described with reference to the accompanying drawings in which like reference characters denote corresponding parts in several views.

Figure 2:
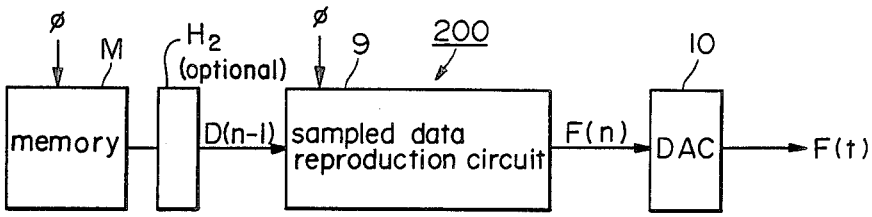
FIG. 2 is a block diagram of a signal reproducing section of the first embodiment of the invention.

FIGS. 1 and 2 show a block diagram of a musical tone generating apparatus according to a first embodiment of the invention, wherein a data write section thereof for writing data representative of an analog signal into a memory M is shown in FIG. 1, and a signal reproducing section thereof for reproducing the analog signal from the data stored in the memory M is shown in FIG. 2.

In FIG. 1, shown at 1 is an analog-to-digital converter (hereinafter referred to as "ADC") which samples an amplitude of an analog input signal F(t) such as a tone signal representative of a tone of an ordinary acoustic musical instrument at an interval defined by a clock signal $\phi$ and successively converts each of the sampled input signals F(t) into a digital data or a digital sampled data F(n). The sampled data F(n) are successively outputted to a prediction data generating circuit 2 and a subtractor 3. The prediction data generating circuit 2 generates a prediction data FY(n−1) based on a formula such as one given below and outputs it to the subtractor 3.

$$FY(n-1)=[F(n-2)+F(n)]/2 \quad (1)$$

Figure 3:
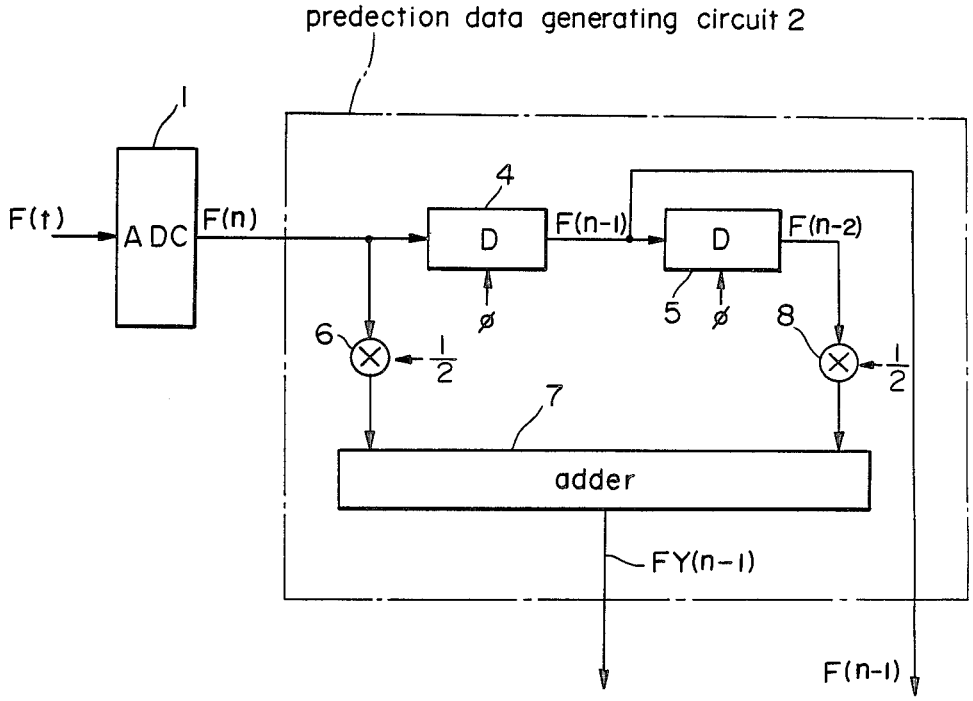
FIG. 3 is a circuit diagram of the prediction data generating circuit 2 of the data write section of FIG. 1.

FIG. 3 shows a circuit diagram of the prediction data generating circuit 2 by way of example. In FIG. 3, shown at 4 is a register for storing the sampled data F(n) in accordance with the clock signal $\phi$. An output of the register 4 is therefore the sampled data F(n−1) which is the sampled data generated a time period equal to one period of the clock signal $\phi$ (one clock time) before the presently generated sampled data or the current sampled data F(n). The output of the register 4 is supplied to another register 5 of the same construction as the register 4. The sampled data F(n) outputted from the ADC 1 is also supplied to a multiplier 6 which multiplies the sampled data F(n) by a coefficient of "½" and supplies the result of this multiplication to an adder 7. An output of the register 5, i. e., the sampled data F(n−2) is supplied to another multiplier 8 which multiplies the sampled data F(n−2) by a coefficient of "½" and supplies the result of the multiplication to the adder 7. The adder 7 adds the outputs of the multipliers 6 and 8 together to obtain the prediction data FY(n−1) as the result of the addition.

Figure 4:
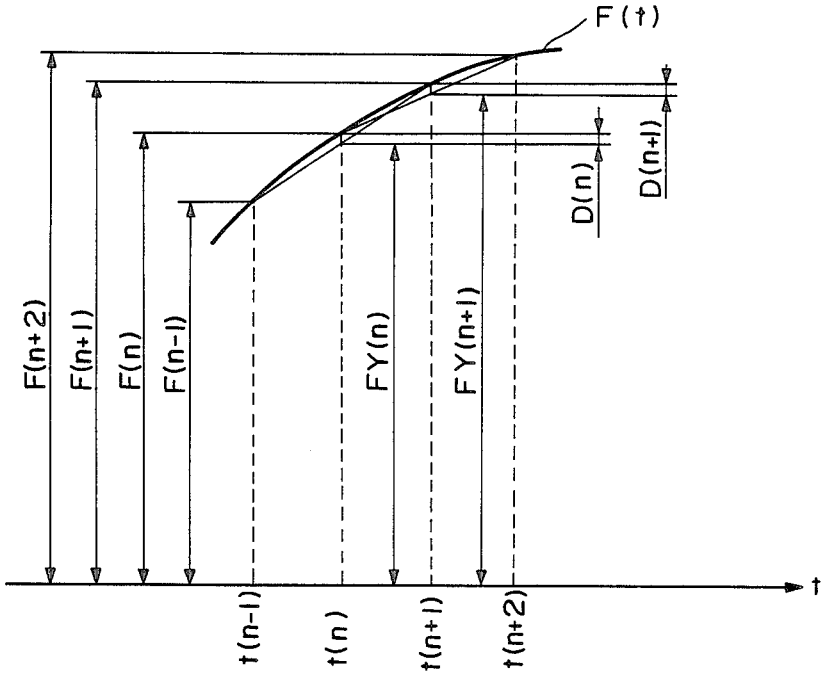
FIG. 4 is an illustration showing the relation between the difference data D(n) and D(n+1) and the prediction data FY(n) and F(n+1) in the first embodiment of the invention.

Assuming that the analog tone signal F(t) has a waveform shown in FIG. 4, the ADC 1 outputs sampled data F(n−1), F(n), F(n+1) and F(n+2) at times t(n−1), t(n), t(n+1) and t(n+2), respectively. At the time t(n+1), the prediction data generating circuit 2 adds the sampled data F(n−1) to the sampled data F(n+1), which is supplied thereto at this instant, and divide the result of this addition by "2" to produce the prediction data FY(n) to be outputted. In a similar manner, at the time t(n+2), the prediction data generating circuit 2 generates the prediction data FY(n+1) based on the sampled data F(n) and F(n+2) and outputs the generated data. The subtractor 3 delays the sampled data F(n−1) by a time period equal to one period of the clock pulse $\phi$ or one clock time and subtracts the prediction data FY(n−1) from this delayed sampled data F(n−1) to form a difference data D(n−1). More specifically, the subtractor 3 calculates the difference data D(n−1) based on the following formula (2) at the time t(n) and outputs it.

$$D(n-1)=F(n-1)-FY(n-1) \quad (2)$$

As will be appreciated from FIG. 4, the difference data D(n) is sufficiently smaller than the sampled data F(n), so that the number of bits of the difference data D(n) is also much less than that of the sampled data F(n). And in this case, the prediction data generating circuit 2 and the subtractor 3 constitute a data compression circuit 100 of this system.

The difference data D(n) thus obtained in the above-mentioned manner are successively stored into the memory M.

Referring now to FIG. 2, there is shown at 9 a sampled data reproduction circuit which reads the stored difference data D(n−1) out of the memory M and reproduces the sampled data F(n) in accordance with the read difference data D(n−1). This reproduction circuit 9 will now be more fully described.

Formula (3) shown below is obtained by substituting the formula (1) for the formula (2).

$$D(n-1)=F(n-1)-[F(n-2)+F(n)]/2 \text{ or } D(n)=F(n)-[F(n-1)+F(n+1)]/2 \quad (3)$$

This formula (3) can be modified to obtain $$F(n+1)=2[F(n)-D(n)]-F(n-1)$$

or $$F(n)=2[F(n-1)-D(n-1)]-F(n-2) \quad (4)$$

The sampled data reproduction circuit 9 reproduces the sampled data F(n) based on the above formula (4). This reproduction operation of the circuit 9 will now be more specifically described on the assumption that first sampled data F(0) and the second sampled data F(1) of the sampled data F(n) have previously been stored in the sampled data reproduction circuit 5. The reproduction circuit 9 first sequentially reads the sampled data F(0) and F(1) in accordance with the clock pulse $\phi$, and then effects a calculation operation defined by the formula (4) on the read sampled data F(0) and F(1) and the difference data D(1) read from the memory M. More specifically, the difference data D(1) is subtracted from the data F(1), and the result of this subtraction is multiplied by "2". Then, the data F(0) is subtracted from the result of the multiplication to obtain the sampled data F(2). After sequentially outputting the first and second sampled data F(0) and F(1), the reproduction circuit 9 outputs the thus reproduced sampled data F(2) to a digital-to-analog converter (hereinafter referred to "DAC") 10. Then, after a lapse of one clock time of the clock pulse $\phi$, the reproduction circuit 9 subjects the difference data D(2) read from the memory M to the calculation operation defined by the formula (4) and outputs the sampled data F(3) reproduced as the result of the calculation operation to the DAC 10. Thereafter, an operation similar to the above-described operation is repeated, and the sampled data F(n) reproduced by the operation are successively supplied to the DAC 10. In this case, the sampled data reproduction circuit 9 constitutes a data expansion circuit 200 of this system. The DAC 10 converts each of the thus supplied sampled data F(n) into an analog signal and outputs it. Thus, an analog signal identical with the inputted tone signal F(t) is outputted from the DAC 10, although the outputted analog signal includes therein some quantization errors.

With this construction, the storage capacity of the memory M required to store the data representative of the tone signal F(t) can be remarkably reduced in comparison with the conventional digital signal processing system of the type in which each sampled data is directly stored in a memory. Furthermore, the sampled data F(n) can be reproduced by the sampled data reproducing circuit 9 in a simple manner.

A second embodiment of the invention will now be described.

Figure 5:
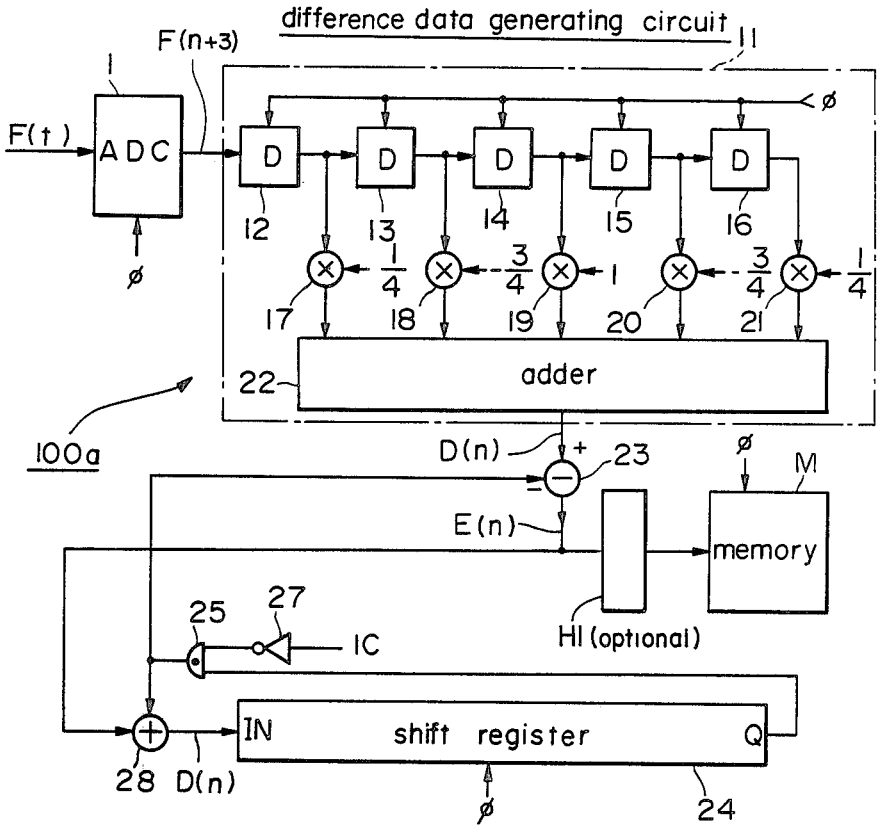
FIG. 5 is a block diagram of a data write section of a musical tone generating apparatus according to a second embodiment of the invention.

FIG. 5 shows a block diagram of a data write section of the musical tone generating apparatus. This musical tone generating apparatus is so designed that it processes a periodic signal such as a tone signal representative of a tone of an acoustic musical instrument, and is improved so as to be superior to the system shown in FIGS. 1 and 2 in the following two respects (1) and (2):

(1) It is well known that a tone signal representative of a tone of a musical instrument has a periodicity. The first improvement of the musical tone generating apparatus is made in view of the periodicity of the tone signal. With the musical tone generating apparatus shown in FIGS. 1 and 2, the difference data D(n) is stored in the memory M, whereas, With the second embodiment of this invention, a difference between the difference data D(n) in the current period of the tone signal and the difference data D(n) in the preceding period of the tone signal is stored in the memory. The difference between the above two difference data D(n) is referred to as "difference data E(n)". It is now assumed that the tone signal F(t) representative of a tone of a musical signal has a waveform shown in FIG. 7 and that a time t(00) is the time when the tone begins to be generated. In this case, a difference between a difference data $D(K)_1$ obtained at a time $t(K)_1$ in the first period $T_1$ and a difference data $D(K)_2$ obtained at a time $t(K)_2$, which is identical in phase to the time $t(K)_1$, in the second period $T_2$ is extremely small. Also, a difference between the difference data $D(K)_2$ and a difference data $D(K)_3$ obtained at a time $t(K)_3$ is extremely small. In view of this fact, with the system shown in FIGS. 5 and 6, the difference data D(n) obtained by that sampling made one period of the tone signal F(t) before the current sampling is subtracted from the difference data D(n) obtained by the current sampling, and the result of this subtraction, that is, the difference data E(n), is written into a memory M (see FIG. 7). In the first period $T_1$ of the tone signal F(t), there is no preceding difference data D(n), so that the difference data $D(n)_1$ is the difference data $E(n)_1$ to be written into the memory M.

Thus, the difference data E(n) is much smaller than the difference data D(n), so that the amount of data to be stored in the memory M in this embodiment becomes much smaller than that in the system shown in FIGS. 1 and 2. Also, reproduction of the sampled data F(n) from the difference data E(n) can be established with a simple circuit as will be described later.

Figure 8:
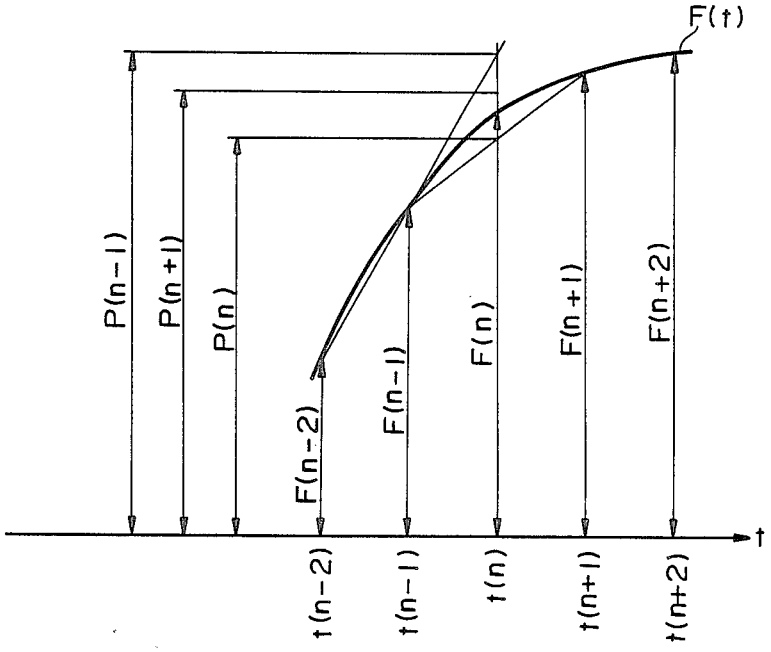
FIG. 8 is an illustration showing the relation between the sampled data F(n) and the prediction data P(n) in the second embodiment of the invention.

(2) With the apparatus shown in FIGS. 1 and 2, the prediction data FY(n) is calculated from the two sampled data F(n−1) and F(n+1) (refer to the formula (1)), whereas with the second embodiment of the invention a prediction data FYa(n) is calculated from four sampled data F(n−2), F(n−1), F(n+1) and F(n+2). The calculation of the prediction data FYa(n) will now be described with reference to FIG. 8.

First, three prediction data P(n−1), P(n) and P(n+1) are calculated respectively from the sampled data F(n−2) and F(n−1), the sampled data F(n−1) and F(n+1), and the sampled data F(n+1) and F(n+2). These calculations are carried out based on the following three formulas:

$$P(n-1)=F(n-1)+[F(n-1)-F(n-2)] \quad (5)$$

$$P(n)=[F(n-1)+F(n+1)]/2 \quad (6)$$

$$P(n+1)=F(n+1)-[F(n+2)-F(n+1)] \quad (7)$$

The prediction data P(n−1), P(n) and P(n+1) are multiplied respectively by weighting coefficients of "1", "2" and "1" and the results of these multiplications are summed. The sum is then divided by "4" to obtain the prediction data FYa(n) as shown below.

$$FYa(n)=[P(n-1)+2P(n)+P(n+1)]/4 \quad (8)$$

The foregoing is the basic concept of the calculation of the prediction data FYa(n).

Next, by substituting the formulas (5) to (7) for the formula (8), the following formula is obtained:

$$FYa(n)=[-F(n-2)+3F(n-1)+3F(n+1)-F(n+2)]/4 \quad (9)$$

The prediction data FYa(n) is calculated based on this formula (9).

Thus, according to this method of calculation, the prediction data FYa(n) which is much closer in value to the actual sampled data F(n) than the prediction data FY(n) in the first embodiment can be obtained. And therefore, the number of bit or the value of the difference data D(n) becomes much smaller. Incidentally, the aforesaid weighting coefficients can be determined by using, for example, the method of least squares so that the difference between the sampled data F(n) and the prediction data FYa(n) becomes minimum.

The construction of the musical tone generating apparatus according to the second embodiment of the invention will now be described with reference to FIGS. 5 and 6. In FIG. 5, there is shown a data write section of the musical tone generating apparatus. The tone signal F(t) representative of a tone of a musical instrument is converted into a digital sampled data F(n) by a ADC 1 in accordance with a clock signal $\phi$ and supplied to a difference data generating circuit 11. The difference data generating circuit 11, which corresponds to the prediction data generating circuit 2 and subtractor 3 of the apparatus shown in FIG. 1, calculates the difference data D(n) by subtracting the aforesaid prediction data FYa(n) from the sampled data F(n), as indicated below.

$$D(n)=F(n)31\ FYa(n) \quad (10)$$

By substituting the formula (9) for the above formula (10), the following formula is obtained:

$$D(n)=[F(n-2)-3F(n-1)+4F(n)-3F(n+1)+F(n+2)]/4 \quad (11)$$

The difference data generating circuit 11 calculates the difference data D(n) based on this formula (11) as described below and outputs it.

Shown at 12 to 16 are serially connected registers each composed of a predetermined number of D-type flip-flops (hereinafter referred to as "DFFs") which are triggered by the clock pulse $\phi$. The sampled data F(n) are sequentially inputted to the first register 12 and shifted from one register to another in accordance with the clock pulse $\phi$. Outputs of the registers 12 to 16 are supplied to multipliers 17 to 21 to be multiplied by "$\frac{1}{4}$", "$-\frac{3}{4}$", "1", "$-\frac{3}{4}$" and "$\frac{1}{4}$", respectively. Outputs of the multipliers 17 to 21 are added together by an adder 22 and outputted therefrom as the difference data D(n). Each of the multipliers 17 to 21 may be of a simple construction comprising a data shift circuit and adders. Thus, at the time t(n+2), the sampled data F(n+2), F(n+1), F(n), F(n−1) and F(n−2) are loaded respectively into the registers 12 to 16, so that the adder 22 outputs the difference data D(n) obtained based on the formula (11). The construction of this difference data generating circuit 11 is identical to that of a linear-phase FIR filter.

The difference data D(n) outputted from the adder 22 is supplied to a + input terminal of a subtractor 23. This subtractor 23 subtracts data at a − input terminal thereof from the data D(n) supplied to the + input terminal thereof and outputs the result of this subtraction as a difference data E(n). More specifically, this subtractor 23 is provided for subtracting that difference data D(n) which was generated one period (one period of the tone signal F(t)) before, from the current difference data D(n) supplied from the adder 22 and is fed at the − input terminal thereof with data outputted from a shift register 24 through an AND gate 25. The shift register 24 is provided for holding a series of difference data D(n) for a time period equal to one period of the tone signal F(t) and comprises a plurality of stages equal in number to the samplings made during one period of the tone signal F(t). The shift register 24 inputs the difference data D(n) and shifts them from one stage to another in accordance with the clock pulse $\phi$. The difference data D(n) inputted to the first stage of the shift register 24 is therefore outputted from an output terminal Q of the last stage thereof when a time period equal to one period of the tone signal F(t) has lapsed.

A signal IC shown in FIG. 5 is held in a "1" state during the first period $T_1$ of the tone signal F(t), so that an inverter 27 outputs a "0" signal during the first period T1 to cause the AND gate to output data of "0". As a result, the difference data $D(n)_1$ outputted from the adder 22 during the first period $T_1$ are outputted from the subtractor 23 as the difference data $E(n)_1$. These difference data $E(n)_1$ are sequentially written into the memory M and, at the same time, sequentially supplied to an adder 28. The adder 28 adds the difference data $E(n)_1$, i. e., the difference data $D(n)_1$, to the data "0"

outputted from the AND gate 25 and sequentially supplies the results of the addition to the input terminal IN of the shift register 24, so that the difference data $D(n)_1$ are sequentially inputted to the shift register 24.

Then, the signal IC is rendered "0" at the beginning of the second period $T_2$ and held in the "0" state thereafter. When the signal IC is rendered "0", the AND gate 25 opens, so that the difference data D(n) contained in the shift register 24 are supplied through the AND gate 25 to the − input terminal of the subtractor 23 as well as to the input terminal of the adder 28. As a result, during the second period $T_2$, the subtractor 23 outputs difference data $E(n)_2$ defined by a formula given below.

$$E(n)_2 = D(n)_2 - D(n)_1 \quad (12)$$

The difference data $E(n)_2$ are sequentially written into the memory M. On the other hand, the adder 28 outputs the sum of the difference data $E(n)_2$ and the difference data $D(n)_1$ which are equal to the $D(n)_2$ as shown below.

$$E(n)_2 + D(n)_1 = D(n)_2 - D(n)_1 + D(n)_1 = D(n)_2 \quad (13)$$

And the difference data $D(n)_2$ are successively inputted to the shift register 24.

Thereafter, an operation similar to the above-described operation is repeated, and as a result the difference data $E(n)_1$, $E(n)_2$, . . . are successively stored in the memory M.

Figure 9:
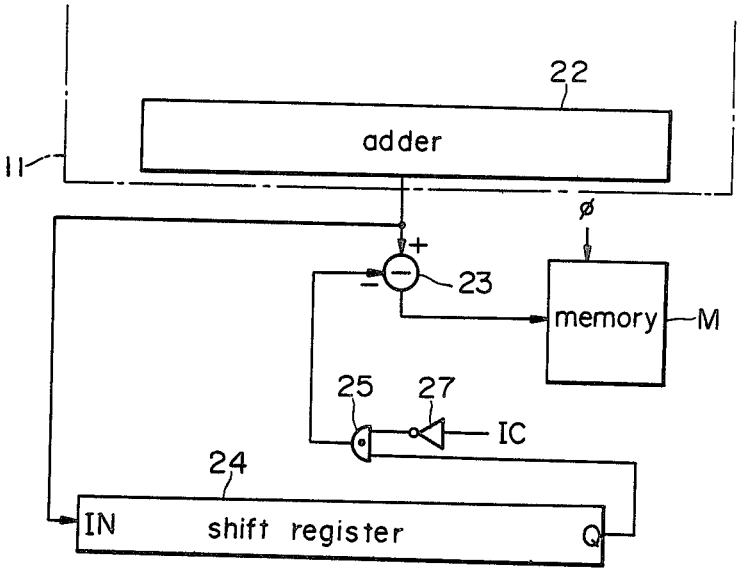
FIG. 9 is a circuit diagram of a modified form of the part of the data write section of FIG. 5.

The aforesaid difference data generating circuit 11, subtractor 23, shift register 24, AND gate 25, inverter 27 and adder 28 constitute a data compression circuit 100*a* of this embodiment. The circuit portion shown in the lower half of FIG. 5 may be modified as shown in FIG. 9. The circuit of FIG. 9 differs from that circuit portion shown in FIG. 5 in that the adder 28 is omitted.

Figure 6:
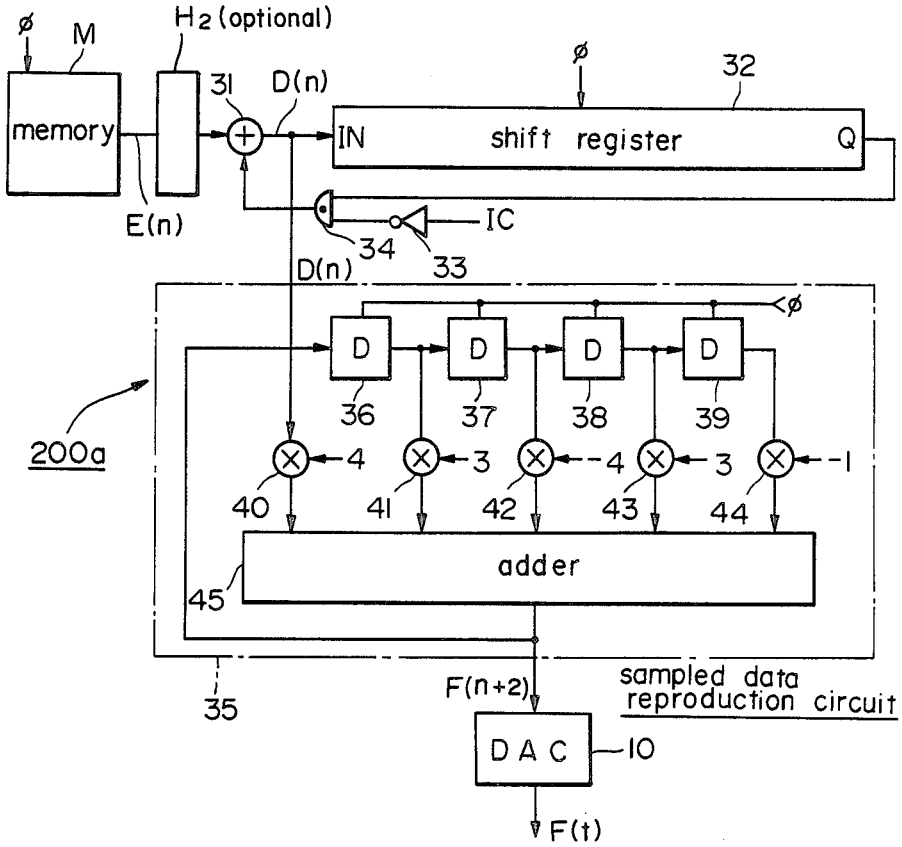
FIG. 6 is a block diagram of a signal reproducing section of the second embodiment of the invention.
Figure 7:
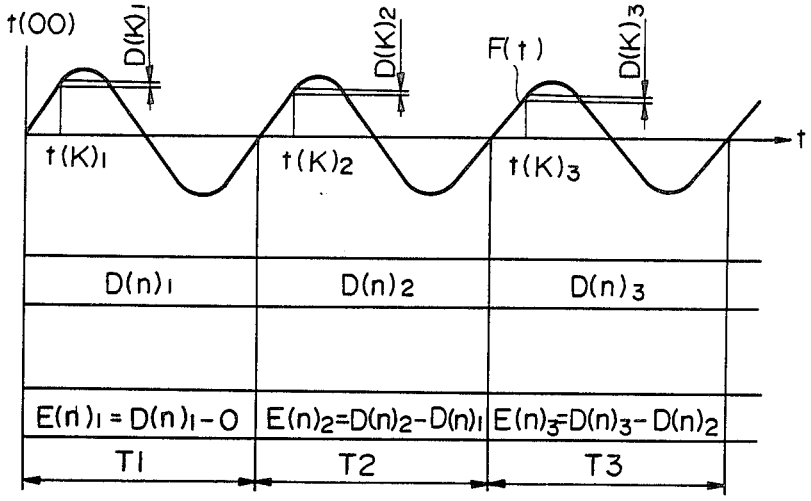
FIG. 7 is an illustration showing the waveform of each of the input signal F(t), the difference data D(n) and the prediction data E(n) in the second embodiment of the invention.

Referring now to FIG. 6, there is shown a signal reproducing section of this musical tone generating apparatus. The difference data E(n) read out of the memory M are supplied to one input terminal of an adder 31. The readout of the difference data E(n) is carried out in accordance with the clock pulse $\phi$. The adder 31 and a shift register 32 are provided for the purpose of reconstructing the difference data D(n) from the read difference data E(n). During the time when the difference data $E(n)_1$ corresponding to the first period $T_1$, i. e., the difference data $D(n)_1$, are read from the memory M, the signal IC is in the state of "1", so that an inverter 33 outputs a "0" signal to cause an AND gate 34 to output data of "0". The data of "0" thus outputted from the AND gate 34 is supplied to the other input terminal of the adder 31. As a result, the difference data $D(n)_1$ are outputted from the adder 31 and supplied to a sampled data reproduction circuit 35 as well as to the shift register 32. This shift register 32 is identical in construction to the shift register 24 shown in FIG. 5 and sequentially stores thereinto the difference data $D(n)_1$ supplied from the adder 31. Each of the thus stored difference data $D(n)_1$ is shifted from one stage to another in accordance with the clock pulse $\phi$ and outputted from an output terminal Q of the last stage of the shift register 32 when a time period equal to one period of the tone signal F(t) has lapsed. When the difference data $E(n)_2$ corresponding to the second period $T_2$ begin to be outputted from the memory M, the signal IC is rendered "0". This signal IC is kept in the "0" state thereafter, so that the AND gate 34 opens to sequentially supply the difference data $D(n)_1$ contained in the shift register 32 through the AND gate 34 to the other input terminal of the adder 31. As a result, the difference data $D(n)_2$ defined by a formula shown below are outputted from the adder 31.

$$E(n)_2 + D(n)_1 = D(n)_2 - D(n)_1 + D(n)_1 = D(n)_2 \quad (14)$$

The difference data $D(n)_2$ thus outputted from the adder 31 are supplied to the sampled data reproduction circuit 35 and also sequentially inputted to the shift register 32. And thereafter, an operation similar to the above operation is repeated, so that the difference data $D(n)_1$, $D(n)_2$, . . . are sequentially supplied to the sampled data reproduction circuit 35.

The sampled data reproduction circuit 35 then reproduces the sampled data F(n) from the difference data D(n). As mentioned before, the difference data D(n) is formed based on the formula (11) which can be modified as follows:

$$F(n+2) = -F(n-2) + 3F(n-1) - 4F(n) + 3F(n+1) + 4D(n) \quad (15)$$

The sampled data reproduction circuit 35 reproduces the sampled data F(n) based on the above formula (15).

The sampled data reproduction circuit 35 will now be more fully described. The sampled data reproduction circuit 35 comprises serially connected registers 36 to 39 each composed of a plurality of DFFs, multipliers 40 to 44 and an adder 45. It is assumed that the difference data D(2) is now outputted from the adder 31. It is also assumed that the sampled data F(0), F(1), F(2) and F(3) are stored respectively in the registers 39, 38, 37 and 36 at this time, the sampled data F(0) being the first one of the sampled data F(n). In this case, the multipliers 44, 43, 42 and 41 multiply the sampled data F(0), F(1), F(2) and F(3) by coefficients of "−1", "3", "−4" and "3", respectively, and output the results of the respective multiplications to the adder 45. On the other hand, the multiplier 40 multiplies the difference data D(2) by a coefficient of "4" and supplies the multiplication result to the adder 45. And therefore, when the difference data D(n) is outputted from the adder 31, the adder 45 outputs the data shown below.

$$-F(0) + 3F(1) - 4F(2) + 3F(3) + 4D(2) \quad (16)$$

This data is the sampled data F(4), as will be appreciated from the formula (15). Thus, when the difference data D(2) is outputted from the adder 31, the adder 45 outputs the sampled data F(4) to a DAC 10 and the input terminal of the register 36. One clock time of the clock pulse $\phi$ later, the adder 31 outputs the difference data D(3) whereupon the adder 45 outputs $$-F(1) + 3F(2) - 4F(3) + 3F(4) + 4D(3) \quad (17)$$

i.e., the sampled data F(5), since the sampled data F(4) to F(1) are stored respectively in the registers 36 to 39 at this time. In a similar manner, when the adder 31 sequentially outputs the difference data D(4), D(5), . . . , the adder 45 sequentially outputs the sampled data F(6), F(7), . . . to the DAC 10. Thus, an analog signal identical to the tone signal F(t) of the tone of the musical instrument can be obtained at an output terminal of the DAC 10. The above-described sampled data reproduction circuit 35 is similar in construction to an IIR filter which is a kind of digital filter.

The adder 31, shift register 32, inverter 33, AND gate 34 and sampled data reproduction circuit 35 constitute a data expansion circuit 200*a* of this embodiment.

Although the prediction data FYa(n) is obtained based on the precedingly sampled data F(n−2) and F(n−1) and the subsequently sampled data F(n+1) and F(n+2) in this embodiment, the prediction data FYa(n) may be alternatively obtained based only on those sampled data which produced prior to the current sampled data.

With the structure of the sampled data reproduction circuit 35 shown in FIG. 6, the first to fourth sampled data F(0) to F(3) are stored respectively in the registers 39 to 36 at the beginning of the reproduction of the tone signal F(t). However, the registers 36 to 39 may alternatively be cleared at the beginning of the reproduction of the tone signal. In this case, although the tone signal with respect to the first several sampled data can not be reproduced accurately at the beginning of the reproduction operation, an accurate reproduction of the tone signal can be achieved with respect to the remaining sampled data.

With this embodiment, each difference data E(n) is obtained as a difference between a difference data D(n) in the current period of the tone signal and a corresponding difference data D(n) in that period which is immediately before the current period. Alternatively, each difference data D(n) may be obtained based on a difference between a difference data D(n) in the current period and a corresponding difference data D(n) in a period other than the period immediately before the current period. For example, each difference data D(n) may be obtained based on a difference between a difference data D(n) in the current period and a corresponding difference data D(n) in that period which is two periods before the current period or half a period before the current period. In this case, the number of stage of each of the shift registers 24 and 32 must be equal to that of the sampling points which exist between the two difference data D(n). Also, a memory such as a RAM may substitute for the shift registers 24 and 32 to delay the difference data D(n) by the desired period of time.

It should also be noted that each of the first and second embodiments can be modified by adding a circuit to further reduce the amount of the data to be stored in the memory M. The circuit to be added may be a code converter which converts the difference data D(n) or E(n) into Shannon-Fano codes or Huffman codes to be stored into the memory M.

The Huffman code will now be briefly described.

In the first embodiment, values (0, ±1, ±2, . . . ) are generated as the difference data D(n) at different probabilities. According to the Huffman encoding method, data having a higher probability of generation is assigned a code composed of fewer bits. The Shannon-Fano encoding method is similar in concept to the Huffman encoding method. Table 1shows one example of the relationship between each value of the difference data D(n) and a corresponding Huffman code.

TABLE 1

| Difference data D(n) | Probability of generation (%) | Huffman code HC | Number |
|---|---|---|---|
| 0 | 50.3 | 1 | 1 |
| −1 | 17.5 | 01 | 2 |
| +1 | 10.6 | 001 | 3 |
| others | 9.3 | 0001 | 4+8 |
| −2 | 4.5 | 00001 | 5 |
| +2 | 3.5 | 000001 | 6 |
| −3 | 2.2 | 0000001 | 7 |
| +3 | 2.1 | 00000001 | 8 |

In Table 1, the measurement of the probability of generation is made with respect to a tone signal of a non-electronic musical instrument. The "others" in Table 1 designates any difference data D(n) which is greater than +3 or less than −3, and the Huffman code corresponding to this difference data D(n) is formed by adding a code of "0001" to the difference data D(n) composed of, for example, eight bits.

In order to apply this Huffman encoding method to the first embodiment, an encoder H1 is interposed between the subtractor 3 and the memory M, as indicated in FIG. 1, so that the difference data D(n) are converted into the Huffman codes shown in Table 1 prior to being written into the memory M. Also, a decoder H2 is interposed between the memory M and the sampled data reproduction circuit 9, as indicated in FIG. 2 to reproduce the difference data D(n) from the Huffman codes read from the memory M. The Huffman encoding method can also be applied to the second embodiment in a similar manner as shown in FIGS. 5 and 6. The application of the Huffman encoding method reduces the amount of the data to be stored in the memory M by about three-eighths times.

The result of an experiment made on the circuit of FIG. 5 will now be described.

Figure 10:
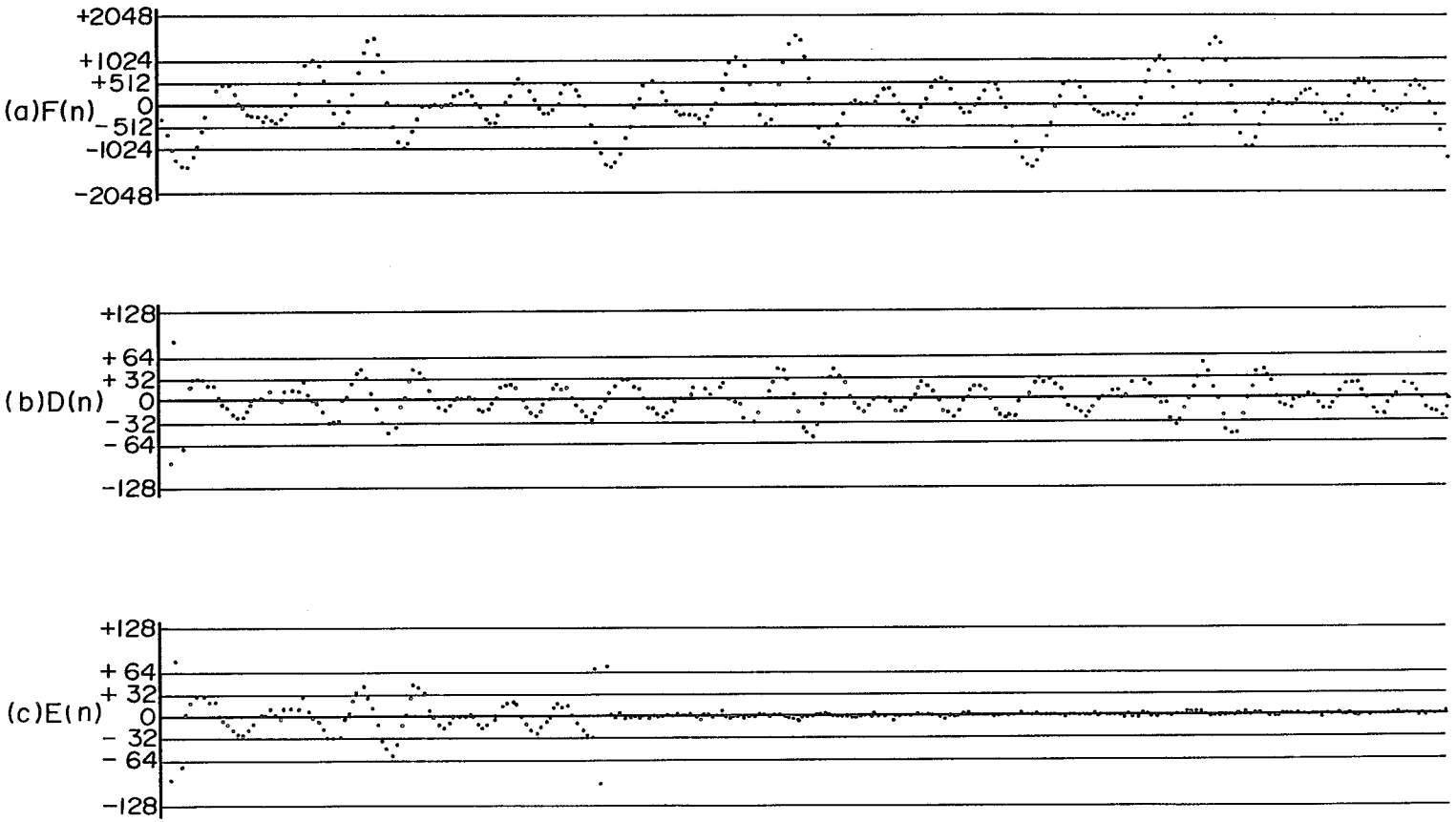
FIGS. 10(*a*)–(*c*) are time charts of the sampled data F(n), the difference data D(n) and the difference data E(n) all obtained as the result of an experiment conducted on the circuit of FIG. 5.
Figure 11:
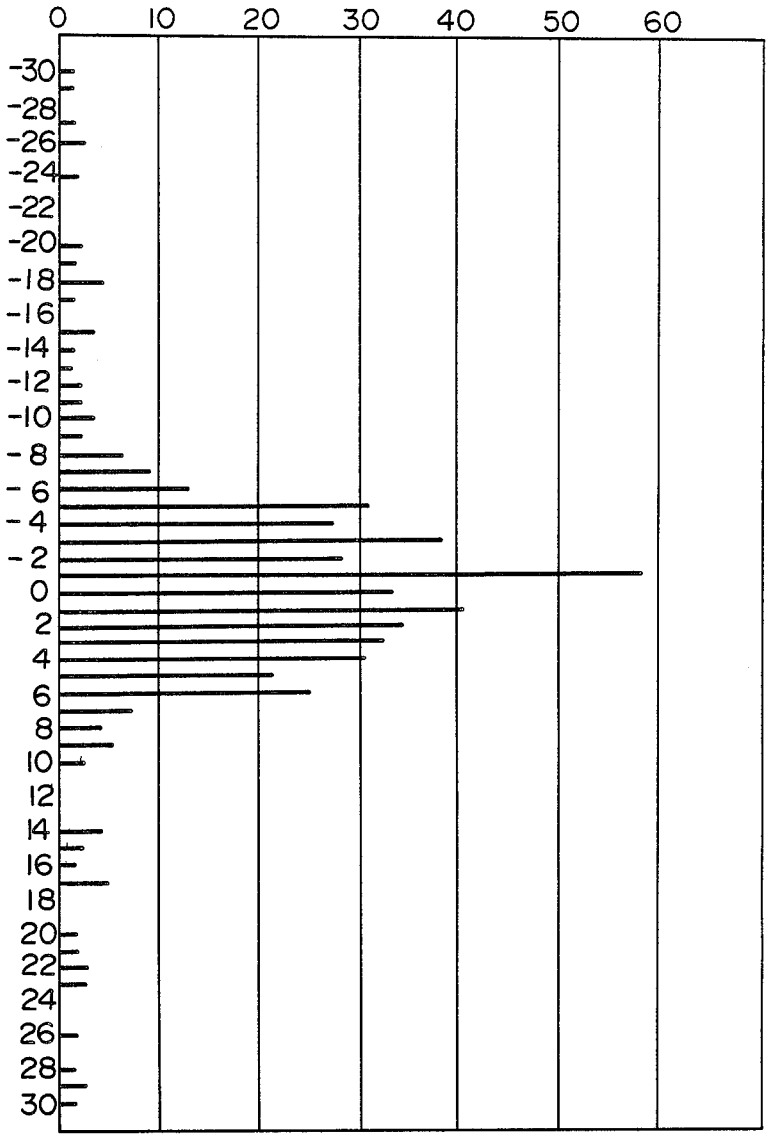
FIG. 11 is an illustration showing various values of the difference data E(n) obtained as the result of an experiment conducted on the circuit of FIG. 5.

FIGS. 10-(*a*) shows the variation of 12-bit sampled data F(n) of a tone signal F(t) representative of a trumpet tone (8′−G4; 392 Hz) of a pipe organ, wherein the tone signal F(t) is sampled at an interval of clock signal $\phi$, i. e., at a sampling rate of 35 KHz. And, FIGS. 10-(*b*) and 10-(*c*) respectively show difference data D(n) and difference data E(n) of the sampled data F(n) shown in FIG. 10-(*a*). As will be appreciated from FIGS. 10-(*a*) to 10-(*c*), the magnitude of the difference data D(n) is much smaller than that of the sampled data F(n), and the magnitude of the difference data E(n) from the second period thereof is much smaller than that of the difference data D(n). FIG. 11 shows how many times each value of the difference data E(n) is generated during the first 512 samples of the tone signal F(t). For example, the difference data E(n) of "0" is generated 33 times, the difference data E(n) of "1" 40 times, the difference data E(n) of "2" 34 times, the difference data E(n) of "−1" 58 times, and the difference data E(n) of "−2" 28 times. In FIG. 11, those of the values of the difference data E(n) which are greater than "+11" or less than "−11" are generated only during the first period of the tone signal F(t), and those difference data E(n) of such large values are hardly generated from the second period of the tone signal F(t). The reason why the difference data E(n) of such large values are generated during the first period of the tone signal F(t) is that the difference data D(n) are used as the difference data E(n) during the first period of the tone signal F(t).

In the aforesaid second embodiment, the difference data generating circuit 11 shown in FIG. 5 is so arranged that the registers 12 to 16 are initially cleared. And the reason why the trumpet tone of a pipe organ is used in the experiment is that the trumpet tone contains a lot of higher harmonic components and has a complicated waveform.

A musical tone generating apparatus to which the first embodiment of the present invention is applied will now be described with reference to FIG. 12.

Figure 12:
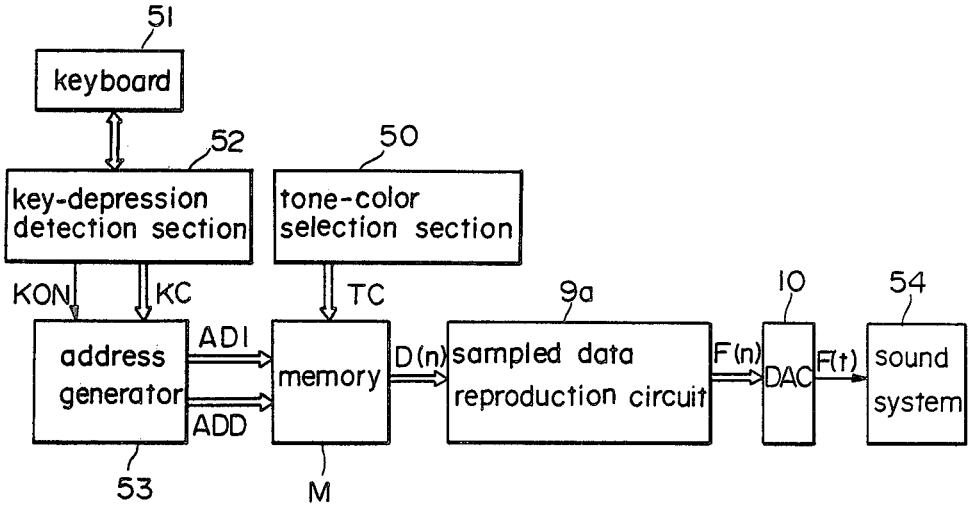
FIG. 12 is a block diagram of an electronic keyboard musical instrument to which the first embodiment of the invention is applied.

As shown in FIG. 12, the musical tone generating apparatus comprises the memory M in which difference data D(n) of an overall waveform of each of a plurality of tone signals F(t) are stored. In this case, difference data D(n) of a plurality of tone signals F(t) of different tone pitches are stored per each of different tone colors such as a piano tone and a flute tone. When a desired one of the tone colors is selected at a tone-color selection section 50, the tone-color selection section 50 outputs data TC to the memory M to designate a memory area thereof where the difference data D(n) of the tone signals F(t) of the selected tone color are stored. When a key is depressed at a keyboard 51, a key-depression detection section 52 detects the depression of the key and outputs a key code KC representative of the depressed key together with a key-on signal KON. The key-on signal KON is kept in a "1" state during the depression of the key. An address generator 53 converts the key code KC fed from the key-depression detection section 52 into a corresponding address data AD1 and outputs it to the memory M. The address generator 53 also outputs to the memory M, from the leading edge of the key-on signal KON, address data ADD of "0" which is incremented by one at a predetermined time interval thereafter. When the address data AD1 is supplied to the memory M, a region in that memory area of the memory M designated by the data TC is selected, the region in the memory area of the memory M corresponding to the address data AD1. The thus selected region stores the difference data D(n) of that of the tone signals F(t) which is of the tone color designated by the tone-color selection section 50 and of the tone pitch designated by the key code KC. And, when the address data ADD is supplied to the memory M, the difference data D(n) are sequentially read out of the addresses of the selected region from its relative address "0" or the first address thereof, and supplied to the sampled data reproduction circuit 9*a*. As a result, the sampled data F(n) are sequentially outputted from the sampled data reproduction circuit 9*a* and converted into an analog tone signal F(t) by the DAC 10. The analog tone signal F(t) thus obtained is supplied to a sound system 54 which in turn amplifies the tone signal F(t) to drive a loudspeaker (not shown) to thereby produce a musical tone.

When it is desired to apply a variation of pitch such as "vibrato" to the produced musical tone, the intervals of the output of the address data ADD may be changed. In this case, the sampled data reproduction circuit 9*a* carries out the processing of data in synchronism with the intervals of the output of the addressed data ADD. Although the memory M stores a plurality of groups of difference data D(n) of different tone pitches per each of different tone colors in the aforesaid apparatus, the memory M may alternatively store only one group of difference data D(n) per each of the different tone colors. Also, the memory M may alternatively store one group of difference data D(n) per a predetermined number of different tone pitches with respect to each of the different tone colors. In this case, the address generator 53 generates the address data ADD at a time interval determined by the key code KC.

A third embodiment of the invention will now be described with reference to FIGS. 13 to 16.

Figure 13:
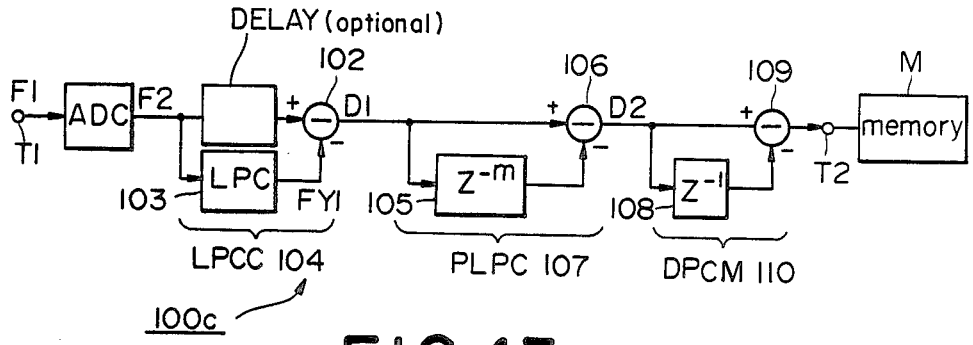
FIG. 13 is a block diagram of a data write section of a musical tone generating apparatus according to a third embodiment of the invention.
Figure 14:
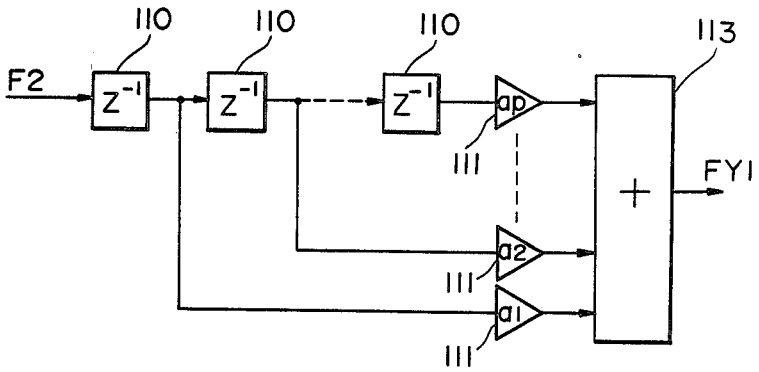
FIG. 14 is a circuit diagram of the LPC 103 of the data write section of FIG. 13.

In FIG. 13, a periodic analog tone signal F1 is supplied through an input terminal T1 to the ADC 1 which converts the tone signal F1 into a digital form at a predetermined sampling rate to produce a sampled digital data F2. The sampled data F2 outputted from the ADC 1 is supplied to a subtractor 102 and a linear predictive coding circuit (hereinafter referred to as "LPC") 103. In this case, the number of samples made by ADC 1 during one period of the tone signal F1 1 is set to "m". The LPC 103 calculates a prediction data FY1 of the sampled data F2 using a well-known linear prediction method and comprises such a circuit as that shown in FIG. 14. In FIG. 14, blocks 110 represent delay circuits of the same construction each of which functions to delay input data thereof by a time period equal to one sampling time of the tone signal F1, as identified by "$Z^{-1}$". Each delay circuit 110 comprises, for example, a register composed of a predetermined number of D-type flip-flops and an output thereof is supplied to a corresponding one of multipliers 111 which are equal in number to the delay circuits 110. The multipliers 111 multiply inputs thereof respectively by coefficients $a_1$, $a_2, \ldots a_p$, and outputs of these multipliers 111 are added together by an adder 113 to obtain the prediction data FY1. With this LPC 103, the prediction data FY1 is calculated based only on the precedingly obtained sampled data. However, the LPC 103 may alternatively calculate the prediction data FY1 based on the precedingly obtained sampled data and the subsequently obtained sampled data. In this case, a delay circuit need be interposed between the ADC 1 and the subtractor 102, as indicated by a broken line in FIG. 13. The subtractor 102 subtracts the output of the LPC 103, i. e., the prediction data FY1, from the output F2 of the ADC 1 and outputs the result of this subtraction as a first difference data D1. As the difference data D1 represents the difference between the sampled data F2 and the prediction data FY1, the difference data D1 is far smaller than the sampled data F2. Thus, the number of bit of the difference data D1 can be reduced to achieve a compression of information. In FIG. 13, that portion of the circuit which comprises the aforesaid subtractor 102 and LPC 103 and is denoted by a reference numeral 104 is hereinafter referred to as "LPCC".

The first difference data D1 outputted from the subtractor 102 is supplied to a delay circuit 105 which delays the first difference data D1 by a time period equal to one period of the tone signal F1, i. e., a time period corresponding to m sampling times as identified by "$Z^{-m}$". The delay circuit 105 may comprise a m-stage shift register. An output of this delay circuit 105 is supplied to a subtractor 106 which subtracts the output of the delay circuit 105 from the output D1 of the subtractor 102 and outputs the result of the subtraction as a second difference data D2. As described above, since the tone signal F1 is a periodic signal, the first difference data D1 also periodically varies in synchronism with the tone signal F1. And therefore, the difference between the presently produced first difference data D1 and the first difference data D1 produced m sampling times before, that is to say, the second difference data D2, is rendered much smaller than the first difference data D1. In other words, the number of bit of the second difference data D2 is smaller than that of the first difference data D1. In FIG. 13, that portion of the circuit which comprises the aforesaid delay circuit 105 and subtractor 106 and is denoted by a reference numeral 107 is hereinafter referred to as "PLPC (periodic linear predictive coding circuit)".

The second difference data D2 thus outputted from the subtractor 106 is supplied to a delay circuit 108 which delays the second difference data D2 by one sampling time and outputs the delayed data to a subtractor 109. The delay circuit 108 comprises, for example, a register composed of D-type flip-flops driven by the clock signal $\phi$. The subtractor 109 subtracts the output of the delay circuit 108 from the second difference data D2 and outputs the result of the subtraction to an output terminal T2. In FIG. 13, that portion of the circuit which comprises the aforesaid delay circuit 108 and subtractor 109 and is denoted by a reference numeral 110 is a well-known modulation circuit based on the differential pulse code modulation method and hereinafter referred to as "DPCM". The aforesaid LPCC 104, PLPC 107 and DPCM 110 constitute a data compression circuit 100*c* of this embodiment.

With the above arrangement, a compression of data is effected at each of the LPCC 104, PLPC 107 and DPCM 110, so that the number of bit of the data obtained at the output terminal T2 is much smaller than that of the sampled data F2 at the output terminal of the ADC 1. Each of the circuit components of the circuit of FIG. 13 may alternatively be constructed by an analog circuit. In this case, the ADC 1 may be interposed between the DPCM 110 and the output terminal T2 so that an ADC of fewer output bits can be used. The data thus obtained at the output terminal T2 is stored into the memory M or transmitted to a remote terminal (not shown) through a transmission line.

Figure 15:
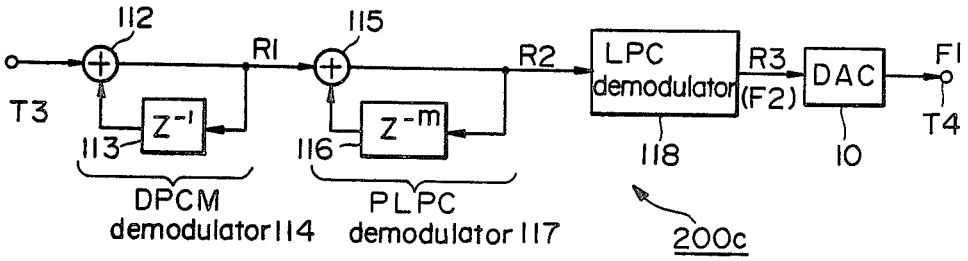
FIG. 15 is a block diagram of a signal reproducing section of the third embodiment of the invention.
Figure 16:
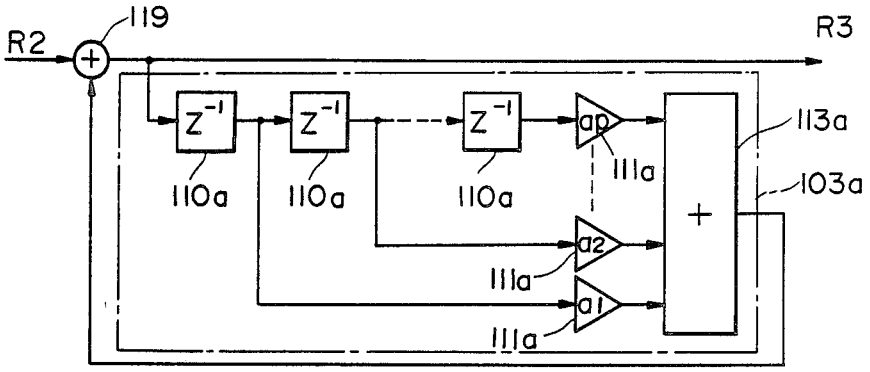
FIG. 16 is a circuit diagram of the LPC demodulator 118 of the signal reproducing section of FIG. 15.

FIG. 15 shows a circuit for reproducing the sampled data F2 from the output data of the circuit of FIG. 13. In FIG. 15, an input terminal T3 is supplied with a series of data which are identical in value and sequence to the data outputted from the output terminal T2 of the data write section of FIG. 13. The respective data of the series of data are sequentially supplied to the input terminal T3 at a time interval equal to that of the samplings made at the ADC 1. The data supplied to the input terminal T3 is fed to an adder 112 whose output is supplied to a delay circuit 113 of the same construction as the delay circuit 108 of FIG. 13. An output of this delay circuit 113 is supplied to the adder 112 and is added thereby to the data fed to the input terminal T3. The adder 112 and the delay circuit 113 constitute a DPCM demodulator 114 for producing a first reproduction data R1 which is identical to the aforesaid second difference data D2. The first reproduction data R1 is supplied to another adder 115 whose output is supplied to a delay circuit 116 of the same construction as the delay circuit 105 of FIG. 13. An output of the delay circuit 116 is supplied to the adder 115 and is added thereby to the first reproduction data R1. The aforesaid adder 115 and delay circuit 116 constitute a PLPC demodulator 117 for producing a second reproduction data R2 which is identical to the first difference data D1. The second reproduction data R2 is supplied to an LPC demodulator 118 which converts the second reproduction data R2 into a third reproduction data R3 which is identical to the sampled data F2. The LPC demodulator 118 has such a construction as that shown in FIG. 16. In FIG. 16, the second reproduction data R2 is supplied to an adder 119 whose output is fed to an input terminal of a circuit 103*a* of the same construction as that of the LPC 103 of FIG. 13. An output of this circuit 103*a* is supplied to the adder 119 to be added to the second reproduction data R2 to thereby produce the third reproduction data R3 or the reproduced sampled data F2. The sampled data F2 thus reproduced is fed to the DAC 10 which in turn converts the sampled data F2 into an analog signal to obtain the reproduced tone signal F1. The aforesaid DPCM demodulator 114, PLPC demodulator 117 and LPC demodulator 118 constitute a data expander circuit 200*c* of this embodiment.

Figure 17:
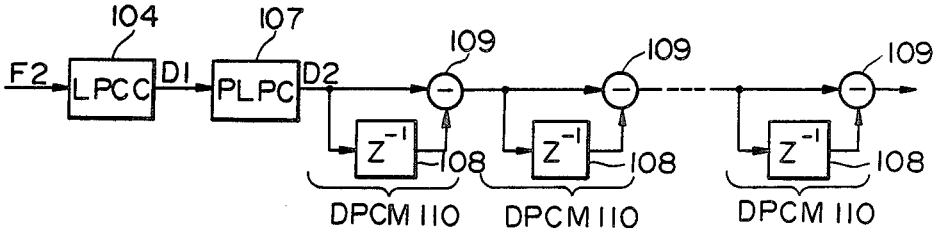
FIG. 17 is a block diagram of a modified form of the data compression circuit 100*c* of the data write section of FIG. 13.

The data compression circuit 100*c* shown in FIG. 13 comprises only one DPCM 110, however the circuit 100*c* may be modified to comprise a plurality of DPCM 110 connected in series to achieve further compression of data as shown in FIG. 17. It is apparent that the circuit 200*c* of FIG. 15 must be modified to have serially connected DPCM demodulators 114 equal in number to the DPCM 110 in this case. Also, each of the delay circuits 105 and 116 may be modified such that data inputted thereto is delayed by 2 m sampling times (a period of time equal to two periods of the tone signal F(t)), 3 m sampling times (a period of time equal to three periods of the tone signal F(t)), or more. Furthermore, each of the delay circuits 108 and 113 may be modified such that data inputted thereto is delayed by two sampling times, three sampling times or more.

A fourth embodiment of the invention will now be described with reference to FIGS. 18 and 19.

Figure 18:
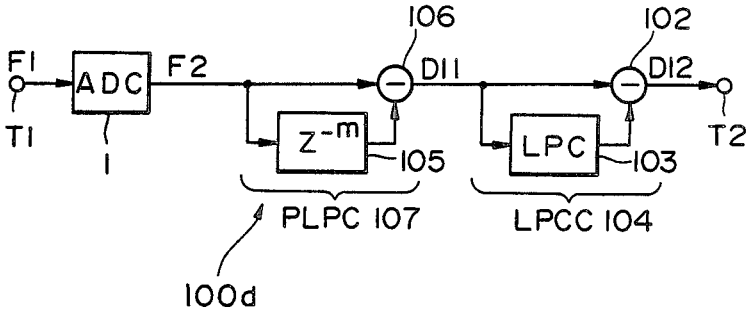
FIG. 18 is a block diagram of a data write section of a musical tone generating apparatus according to a fourth embodiment of the invention.

In FIG. 18, the ADC 1, PLPC 107 and LPCC 104 are serially connected in this order between the input terminal T1 and the output terminal T2. The sampled data F2 outputted from the ADC 1 is first converted into a first difference data D11 by the PLPC 107 and then further converted into a second difference data D12 by the LPCC 104. The thus obtained second difference data D12 is outputted from the output terminal T2 and is written into the memory M or transmitted to a remote terminal. With this arrangement, the sampled data F2 is compressed by the PLPC 107 prior to being supplied to the LPCC 104. And therefore, the number of bit of the data on which the LPCC 104 effects an operation becomes smaller, so that the circuit of the LPCC 104 can be simplified. A data compression circuit 100*d* of this embodiment is thus constituted by the PLPC 107 and the LPCC 104.

Figure 19:
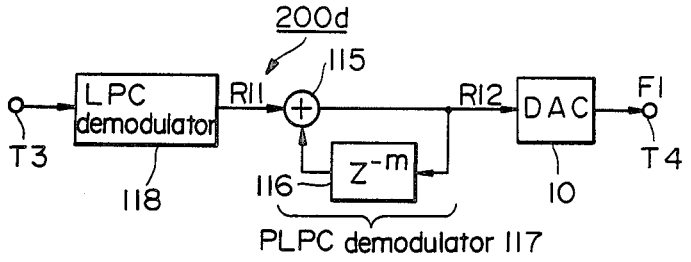
FIG. 19 is a block diagram of a signal reproducing section of the fourth embodiment of the invention.

FIG. 19 shows a signal reproducing section for reproducing the tone signal F1 from the output data D12 of the data write section of FIG. 18. In FIG. 19, the LPC demodulator 118, the PLPC demodulator 117 and the DAC 10 are serially connected in this order between the input terminal T3 and the output terminal T4. The data D12 supplied to the input terminal T3 is first converted by the LPC demodulator 118 into a first reproduction data R11 which is identical to the data D11 shown in FIG. 18. The first reproduction data R11 is then converted by the PLPC demodulator 117 into a second reproduction data R12 which is identical to the sampled data F2 shown in FIG. 18. The thus obtained second reproduction data R12 is further converted into an analog form by the DAC 10 to obtain the reproduced tone signal F1 which is taken from the output terminal T4. The LPC demodulator 118 and the PLPC demodulator 117 constitute a data expander circuit 200*d* of this fourth embodiment.

A fifth embodiment of the invention will now be described with reference to FIGS. 20 and 21.

The tone signal F1 applied to the input terminal T1 is converted by the ADC 1 into the sampled data F2 which is then compressed by the LPCC 104 to obtain a first difference data D21. This first difference data D21 is further compressed by a PLPC 122 to obtain a second difference data D22 which is supplied to the output terminal T2. The PLPC 122 is similar to the PLPC 107 of FIG. 13 but differs therefrom in that a multiplier 123 is connected to the input terminal of the delay circuit 105 so that the first difference data D21 is multiplied by a coefficient A prior to being supplied to the delay circuit 105. The coefficient A has a value of near "1" and is set to such a value that allows an efficient compression of data to be effected at the PLPC 122. The reason why the first difference data D21 is multiplied by the coefficient A will now be described. It is assumed here that the first difference data D21 increases at a constant rate. In this case, if the first difference data D21 is multiplied by a coefficient corresponding to the rate of increase thereof prior to application to the delay circuit 105, the difference between the current difference data D21 and the output of the delay circuit 105 becomes smaller. As a result, the efficiency of compression of data is improved. Thus, the coefficient A may be determined in accordance with the rate of variation of the difference data D21, and it is preferable that the coefficient A be varied with the lapse of time. In FIG. 20, the multiplier 123 may alternatively be connected to the output terminal of the delay circuit 105. In this case, if the second difference data D22 obtained at the output terminal T2 is stored into a memory, the coefficient A need be stored into the memory simultaneously. A data compression circuit 100*e* of this fifth embodiment is constituted by the LPCC 104 and the PLPC 122.

Figure 20:
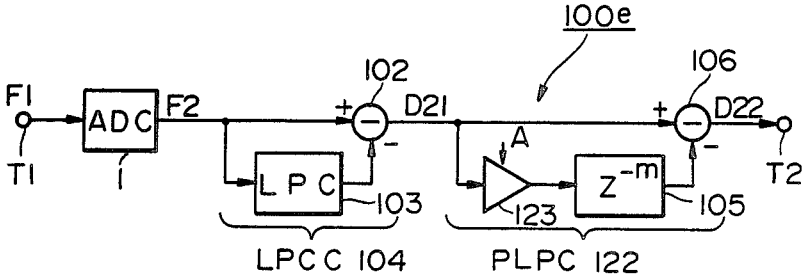
FIG. 20 is a block diagram of a data write section of a musical tone generating apparatus according to a fifth embodiment of the invention.
Figure 21:
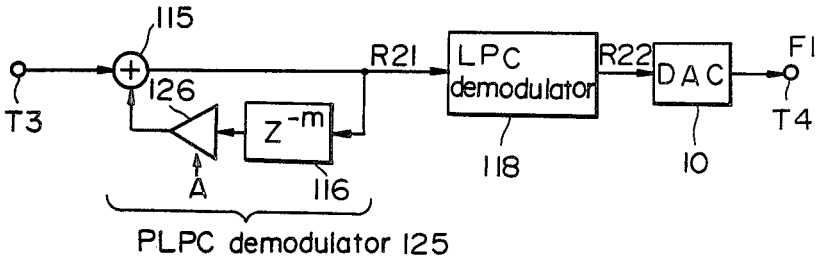
FIG. 21 is a block diagram of a signal reproducing section of the fifth embodiment of the invention.

FIG. 21 shows a signal reproducing section of this embodiment for reproducing the tone signal F1 from the data D22 compressed by the circuit shown in FIG. 20. In FIG. 21, the data supplied to the input terminal T3 is converted by a PLPC demodulator 125 into a first reproduction data R21 which is identical to the aforesaid first difference data D21. The PLPC demodulator 125 is similar to the PLPC 117 of FIG. 15 but differs therefrom in that a multiplier 126 is connected to the output terminal (or the input terminal) of the delay circuit 116 so that the output (or the input) of the delay circuit 116 is multiplied by the coefficient A prior to application to the adder 115. The first demodulation data R21 outputted from the PLPC demodulator 125 is then converted by the LPC demodulator 118 into a second reproduction data R22 which is identical to the sampled data F2. The thus obtained second reproduction data R22 is further converted by the DAC 10 into an analog form to obtain the reproduced tone signal F1 which is taken from the output terminal T4.

Modified forms of the above fifth embodiment will now be described.

Figure 22:
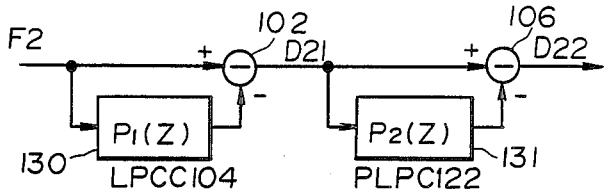
FIG. 22 is a block diagram of the data compression circuit 110*e* of the data write section of FIG. 20.

FIG. 22 again shows that portion of the circuit of FIG. 20 disposed downstream of the ADC 1. In FIG. 22, block 130 represents the LPC 103 of FIG. 20 and block 131 represents the combination of the multiplier 123 and the delay circuit 105. $P_1(z)$ and $P_2(z)$ shown respectively in the blocks 130 and 131 are transfer functions thereof and can be expressed as follows:

$$P_1(z) = \sum_{n=1}^{k} a_n z^{-n} \tag{18}$$

$$P_2(z) = A\,Z^{-m} \tag{19}$$

An overall transfer function of the circuit shown in FIG. 22 is therefore expressed as:

$$[1 - P_1(z)][1 - P_2(z)] =$$

$$1 - P_1(z) - P_2(z) + P_1(z)\,P_2(z) = \tag{20}$$

$$1 - P_1(z) - P_2(z)[1 - P_1(z)] = \tag{21}$$

$$1 - [P_1(z)[1 - P_2(z)] + P_2(z) = \tag{22}$$

Figure 23:
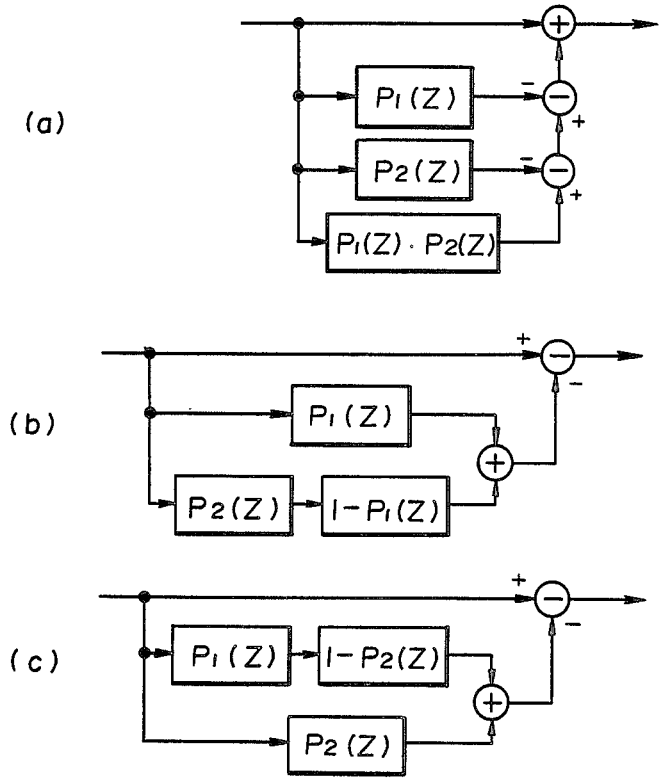
FIGS. 23(*a*) to 23(*c*) are block diagrams of modified forms of the data compression circuit 100*e* of FIG. 22.

FIGS. 23-(*a*), 23-(*b*) and 23-(*c*) show circuits formed based respectively on the above formulas (20), (21) and (22). These circuits are equivalent to the circuit shown in FIG. 22 and can therefore substitute therefor to achieve the same compression of data.

The formulas (20) to (22) are typical examples of the overall transfer function of the circuit shown in FIG. 22, however it will be apparent that the transfer function can be expressed by various other formulas. Also, the circuits shown in, for example, FIGS. 13, 15, 18 and 19 can be modified based on the same concept.

A sixth embodiment of the invention will now be described with reference to FIGS. 24 to 26.

The tone signal F1 applied to the input terminal T1 is converted by the ADC 1 into the sampled data F2 which is first compressed by the DPCM 110 to obtain a first compressed data D31. The first compressed data D31 is supplied to a prediction data generating circuit 132. In the prediction data generating circuit 132, the first compressed data D31 is delayed by the serially connected delay circuits $105_{-1}$ to $105_{-p}$. Outputs of these delay circuits $5_{-1}$ to $5_{-p}$ are multiplied by coefficients $b_1$ to $b_p$ by multipliers $133_{-1}$ to $133_{-p}$, respectively. The results of the respective multiplications are added together by the adders $134_{-1}$, $134_{-2}$, . . . to obtain a prediction data FY2 which is supplied to a subtractor 135. The subtractor 135 subtracts the prediction data FY2 from the current difference data D31 to obtain a second compressed data D32. In this case, each of the coefficients $b_1$ to $b_p$ is smaller than "1" and establishes the following formula (23):

$$b_1 + b_2 + \ldots + b_p = 1 \tag{23}$$

The prediction data generating circuit 132 and the subtractor 135 constitute a modified PLPC 136. The second compressed data D32 is then supplied to an encoder 138, which may comprise the afore Huffman encoder or the Shannon-Fano encoder, to be further compressed. And an output of the encoder 138 is taken from the output terminal T2 and is written into a memory or transmitted to a remote terminal. In the above circuit, the DPCM 110, modified PLPC 136 and encoder 138 constitute a data compression circuit 100*f* of this embodiment.

Figure 25:
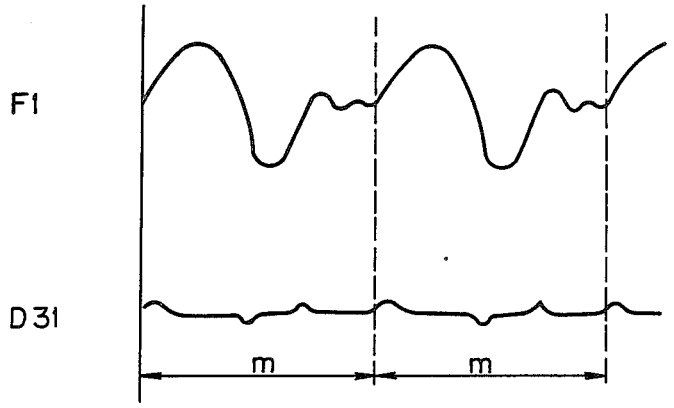
FIG. 25 is an illustration showing the variation of each of the tone signal F1 and the difference data D1 in the data write section of FIG. 24.
Figure 26:
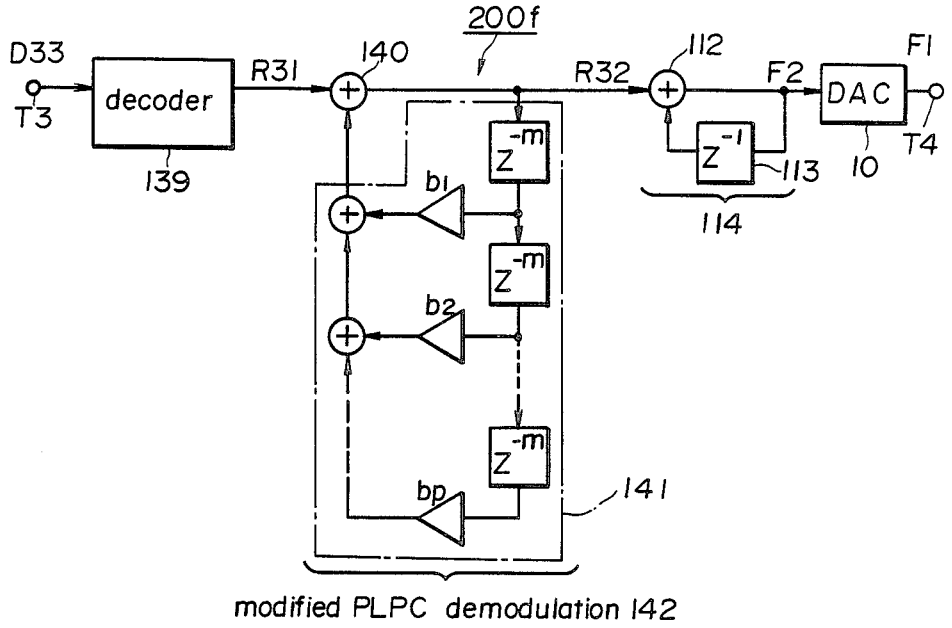
FIG. 26 is a block diagram of a signal reproducing section of the sixth embodiment of the invention.

The data D31 varies periodically, as shown in FIG. 25, in synchronism with the tone signal F1. And therefore, the value of the current data D31 can be predicted from those data generated "1", "2", . . . "p" periods before the current data D31. The prediction data generating circuit 132 is constructed based on the above concept, and can generate a prediction data FY2 very close in value to the current difference data D31 by setting the coefficients $b_1$ to $b_p$ respectively to proper values. It will be appreciated that the more the delay circuits 105 are provided, the closer to the current data D31 the prediction data FY1 becomes. And, the closer to the current data D31 the prediction data FY1 is, the higher the efficiency of data compression of the modified PLPC 136 becomes.

A method of determining the coefficients $b_1$ to $b_p$ will now be described.

The coefficients $b_1$ to $b_p$ are determined using a statistic method as hereunder described. Assuming that the respective values of the series of data D31 are:

$$y_0, y_1, y_2, \ldots, y_m, y_{m+1}, y_{m+2}, \ldots$$

the modified PLPC 136 independently affects each of m time series, namely, $$\begin{array}{lll} y_0, y_m, y_{2m}, & \ldots & \geqq y_{0,j} \\ y_1, y_{m+1}, y_{2m+1}, & \ldots & \geqq y_{1,j} \\ & \vdots & \\ y_{m-1}, y_{2m-1}, y_{3m-1}, & \ldots & \geqq y_{m-1,j} \end{array}$$

And therefore, if auto-correlations of $y_{0,j}$ to $y_{m-1,j}$ are defined as $r_{0,j}$ to $r_{m-1,j}$, respectively, the coefficients $b_1$ to $b_p$ can be obtained by solving a normal equation of another auto-correlation which is obtained based on:

$$r_j = \sum_{k=0}^{m-1} r_{kj} \tag{24}$$

More specifically, the input series $y_n$ is first split into the groups shown below:

$$\left.\begin{array}{lll} y_{0,j}(j=0, 1, \ldots J) & = & y_0, y_m, y_{2m}, \ldots y_{Jm} \\ y_{1,j}(j=0, 1, \ldots J) & = & y_1, y_{m+1}, y_{2m+1}, \ldots y_{Jm+1} \\ & \vdots & \\ y_{m-1,j}(j=0, 1, \ldots J) & = & y_{m-1}, y_{2m-1}, y_{3m-1}, \ldots y_{(J+1)m-1} \end{array}\right\} \tag{25}$$

Then, an auto-correlation is calculated with respect to each of the above formulas as:

$$r_{i,n} = \sum_{j=0}^{J-1} r_{i,j}\, y_{i,j+n} \tag{26}$$

where $i = 0, 1, \ldots m-1$

And a true auto-correlation $\bar{r}_n$ is obtained by summing the above auto-correlations:

$$\bar{r}_n = \sum_{i=0}^{m-1} r_{i,n} \tag{27}$$

And therefore, the coefficients $b_1$ to $b_p$, which render the data D2 minimum is obtained by solving the next normal equation:

$$\begin{bmatrix} \bar{r}_0 & \bar{r}_1 & \cdots & \cdots & \cdots & \bar{r}_{p-1} \\ \bar{r}_1 & \bar{r}_0 & \bar{r}_1 & & & \vdots \\ \vdots & & \ddots & \ddots & & \vdots \\ \vdots & & & \ddots & \ddots & \bar{r}_1 \\ \bar{r}_{p-1} & \cdots & \cdots & \cdots & & \bar{r}_0 \end{bmatrix} \begin{bmatrix} b_1 \\ b_2 \\ \vdots \\ \vdots \\ b_p \end{bmatrix} = \begin{bmatrix} \bar{r}_1 \\ \bar{r}_2 \\ \vdots \\ \vdots \\ \bar{r}_p \end{bmatrix} \tag{28}$$

The above calculation is equivalent to the following procedure:

First, $r_n$ is obtained based on:

$$r_n = \sum_{m=0}^{N} y_m, y_{m+n} \tag{29}$$

Then, $\bar{r}_n$ is obtained as:

$$\bar{r}_n = r_{mn} \tag{30}$$

where; $n = 1, 2, \ldots p$

It is also well known that a linear sum of positive finite auto-correlations is positive finite. And therefore, a demodulation system (see FIG. 26) using the coefficients $b_1$ to $b_p$ is stable.

Figure 24:
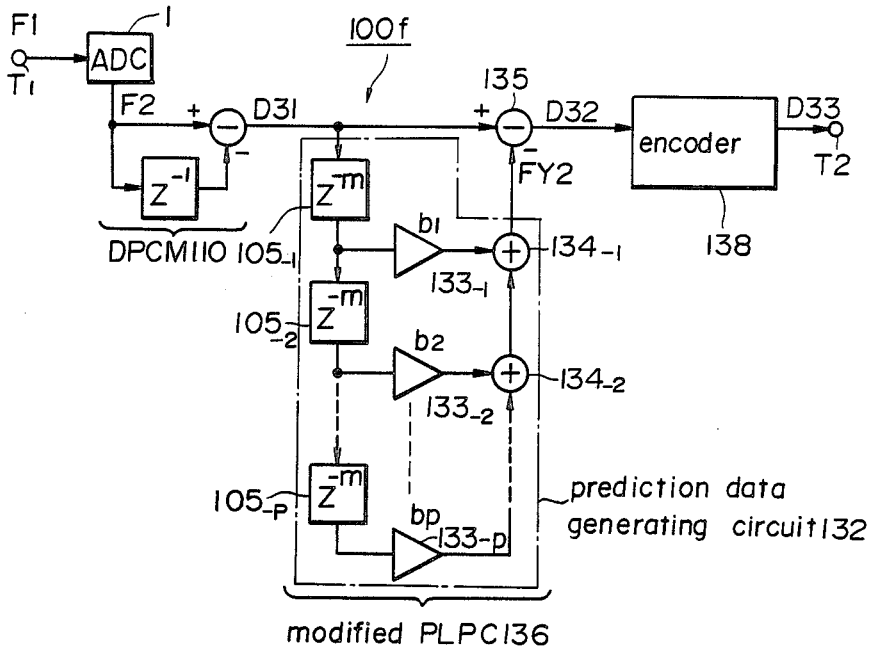
FIG. 24 is a block diagram of a data write section of a musical tone generating apparatus according to a sixth embodiment of the invention.

Thus, the circuit shown in FIG. 24 can achieve a compression of data more efficiently than those shown in FIGS. 13, 18 and 20. FIG. 26 shows a signal reproducing section for reproducing the tone signal F1 from the compressed data D33.

The data D33 applied to the input terminal T3 is decoded by the decoder 139 into a first reproduction data R31 which is supplied to an adder 140. The decoder 139 may be a Huffman decoder or a Shannon-Fano decoder. An output of this adder 140 is supplied to a prediction data generating circuit 141 of the same construction as the prediction data generating circuit 132. And an output of the prediction data generating circuit 141 is supplied to the adder 140 to form a second reproduction data R32. In this case, the adder 140 and the prediction data generating circuit 141 constitute a modified PLPC demodulator 142. The second reproduction data R32 is then converted by the DPCM demodulator 114 into the reproduced sampled data F2 which is supplied to the DAC 10. And the reproduced tone signal F1 is outputted from the DAC 10 through the output terminal T4. The decoder 139, modified PLPC demodulator 142 and DPCM demodulator 114 constitute a data expansion circuit **200*f***.

Figure 27:
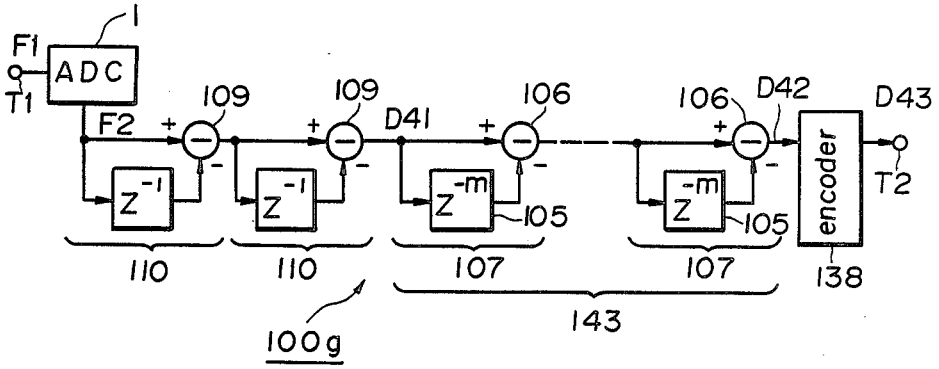
FIG. 27 is a block diagram of a data write section of a musical tone generating apparatus according to a seventh embodiment of the invention.

A seventh embodiment of the invention will now be described with reference to FIGS. 27 and 28.

The tone signal F1 is converted into the sampled data F2 by the ADC 1 and then supplied to serially connected two DPCMs 110 to obtain a first compressed data D41. The first compressed data D41 is supplied to a signal processing circuit 143 which is composed of a plurality of PLPCs 107 connected in series. This signal processing circuit 143 further compresses the first compressed data D41 and outputs a second compressed data D42 which is supplied to the encoder 138. The encoder converts the second compressed data D42 into a third compressed data D43 and outputs it via the output terminal T2. In this case, the serially connected DPCMs 110, signal processing circuit 143 and encoder 138 constitute a data compression circuit **100*g*** of this seventh embodiment.

With this arrangement, if the tone signal F1 varies periodically, the first compressed data D41 also varies periodically. And therefore, the first compressed data D41 can be further compressed by each of the PLPCs 107 of the signal processing circuit 143, whereby the efficiency of data compression of this embodiment is enhanced.

Figure 28:
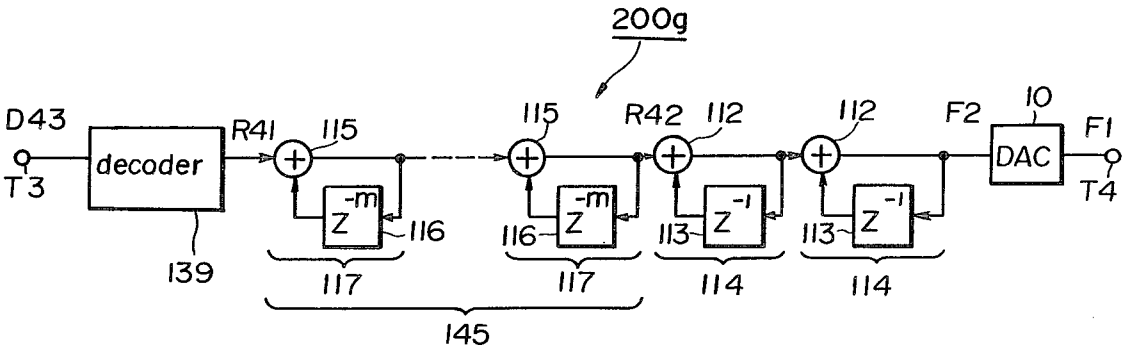
FIG. 28 is a block diagram of a signal reproducing section of the seventh embodiment of the invention.

FIG. 28 shows a signal reproducing section of this sixth embodiment. The compressed data D43 fed to the input terminal T3 is decoded into a first reproduction data R41 by a decoder 139 (a Huffman decoder or a Shannon-Fano decoder). The first reproduction data R41 is then supplied to a signal processing circuit 145 which is composed of serially connected PLPC demodulators 117 equal in number to the PLPCs 107 of the signal processing circuit 143 of FIG. 27. The signal processing circuit 145 converts the first reproduction data R41 into a second reproduction data R42. This second reproduction data R42 is then converted by serially connected two DPCM demodulators 114 into the third reproduction data or the sampled data F2 which is converted by the DAC 10 into the reproduced tone signal F1 and supplied to the output terminal T4. In this case, the decoder 139, signal processing circuit 145 and DPCM demodulators 114 constitute a data expansion circuit 200*g* of this sixth embodiment.

In the above-described embodiment, the DPCMs 110 and the signal processing circuit 143 may alternatively be constructed by analog circuits, in which case the ADC 1 may be disposed downstream of those circuits.

Figure 29:
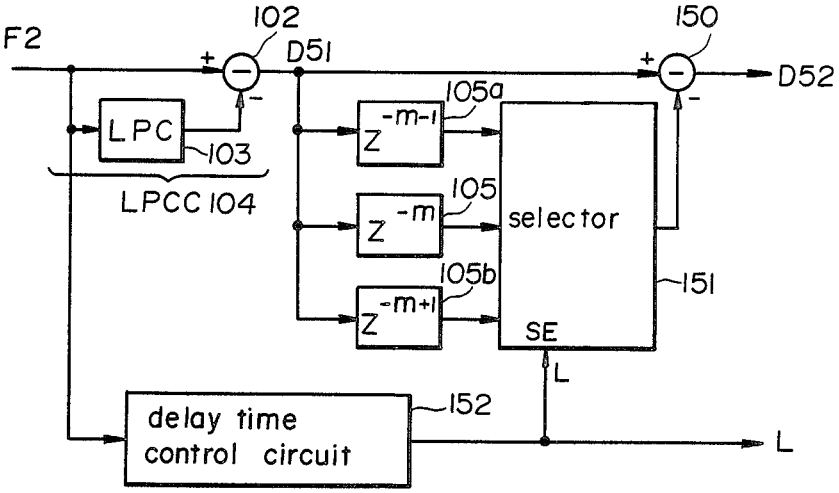
FIG. 29 is a circuit diagram of a further modified form of the PLPC 107.

FIG. 29 shows a further modified circuit of the PLPC 107 of the above-described embodiments.

In the case where the input signal F1 is a tone signal, the period of the input signal F1 to be digitally compressed varies under the influence of vibrato and the fluctuation of pitch of the attack portion of the tone signal. In order to improve the efficiency of data compression, the period of the input signal F1 must therefore be detected to control the delay time in the delay circuit 105 of the PLPC 107. The circuit of FIG. 29 is modified in view of this. In FIG. 29, the sampled data F2 is compressed by the LPCC 104 and supplied to a subtractor 150 as well as to the delay circuits 105*a*, 105 and 105*b*. The delay circuit 105*a* delays the output D51 of the LPCC 104 by "m+1" sampling times, and the delay circuit 5*b* delays the output D51 of the LPCC 104 by "m−1" sampling times. The respective outputs of the delay circuits 105*a*, 105 and 105*b* are supplied to a selector 151. The selector 151 selectively outputs to the subtractor 150 one of the outputs of the delay circuits 105*a*, 105 and 105*b* in accordance with data L supplied to a selection terminal SE thereof. The sampled data F2 is also supplied to a delay time control circuit 152 which determines the period of the sampled data F2 based in accordance with the variation thereof and outputs the selection data L as the result of the determination. The subtractor 150 subtracts the output of the selector 151 from the output D51 of the LPCC 104 to produce a compressed data D52.

With this arrangement, when the period of the sampled data F2 is equal to "m+1" sampling times, the delay time control circuit 152 outputs the data L of such a value that the selector 151 feeds the output of the delay circuit 105*a* to the subtractor 150. On the other hand, the selector 151 supplies the output of the delay circuit 105 to the subtractor 150 when the period of the sampled data F2 is equal to "m", and supplies the output of the delay circuit 105*b* when the period is equal to "m−1". Thus, even if the period of the sampled data F2 varies, the subtractor 150 subtracts from the current data that data which was generated exactly one period before. As a result, the efficiency of data compression is further enhanced.

It will be seen that if the data D52 is stored in a memory, the data L need be simultaneously stored in the memory. Also, the delay circuit 105*a*, 105 and 105*b* the selector 151 can be constituted by a RAM or the like. Furthermore, the efficiency of data compression can be further improved by increasing the number of delay circuits 105 interposed between the LPCC 104 and the selector 151 to allow various delay times, namely, "m−2" sampling times, "m+2" sampling times, . . . to be selected.

Figure 30:
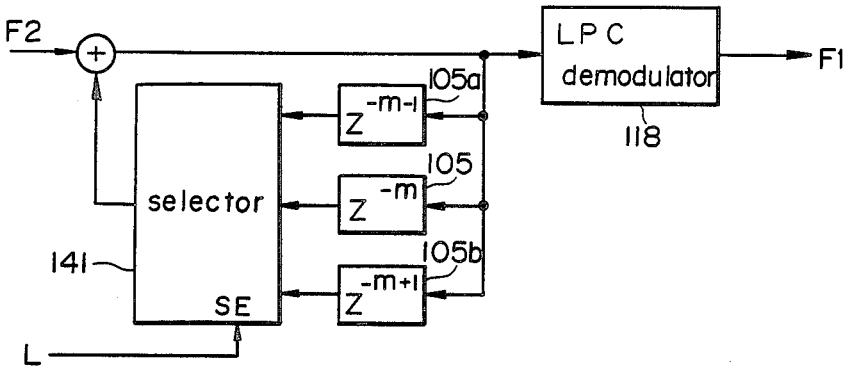
FIG. 30 is a circuit diagram of a PLPC demodulator for the further modified PLPC of FIG. 29.

FIG. 30 shows a circuit for reproducing the data F2 from the data D52 compressed by the circuit of FIG. 29. The construction and operation of this circuit is self-explanatory, and therefore the description thereof is omitted here.

What is claimed is:

1. A musical tone generating apparatus for an electronic musical instrument comprising:

(a) memory means for storing a series of difference data each representing a difference between a corresponding one of a series of sample data representing amplitude values of a musical tone signal and prediction data of said corresponding one of said series of sample data, said prediction data being produced by effecting a first linear operation on those of said series of sample data which have a predetermined relation of time to said corresponding one of said series of sample data; and (b) data reproducing means responsive to each difference data outputted from said memory means for reproducing a corresponding one of said sample data, said data reproducing means adding said each of said outputted difference data to data obtained by effecting a second linear operation on those reproduced sample data which have said predetermined relation of time to said each outputted difference data.

2. A musical tone generating apparatus according to claim 1, wherein said musical tone signal is a periodic signal, and wherein said memory means stores a series of second difference data each representing a difference between a corresponding one of said series of difference data and that of the series of difference data produced at a time interval corresponding to a period of said tone signal before said corresponding one of said series of difference data, said musical tone generating apparatus further comprising second data reproducing means which comprises first delay circuit means for delaying data inputted thereto by said time interval to output delayed data, and first adder means for adding said each second difference data outputted from said memory means to said delayed data, each addition result being supplied to said first delay circuit means as said data and to said data reproducing means as said outputted difference data.

3. A musical tone generating apparatus according to claim 2, wherein said memory ,means further stores variation data representative of the variation of the period of said musical tone signal together with said second difference data, said first delay circuit means varying said time interval in accordance with said variation data outputted from said memory means.

4. A musical tone generating apparatus according to claim 2, wherein said first delay circuit means further comprises multiplier means for multiplying one of the input and output data of said first delay circuit means by a predetermined coefficient chosen in accordance with said first and second linear operations.

5. A musical tone generating apparatus according to claim 2, wherein said second data reproducing means further comprises a plurality of circuit means connected in series and each having the same construction as said second data reproducing means.

6. A musical tone generating apparatus according to claim 2, wherein said memory means stores a series of third difference data each representing a difference between a corresponding one of said series of second difference data and that of the series of second difference data produced at a second time interval corresponding to a predetermined number of sampling intervals of said tone signal before said corresponding one of said series of second difference data, said musical tone generating apparatus further comprising third data reproducing means comprising second delay circuit means for delaying data inputted thereto by said second time interval to output delayed data, and second adder means for adding each of said third difference data outputted from said memory means to said delayed data outputted from said second delay circuit means, each addition result being supplied to said second delay circuit means as said data and to said first adder means as said outputted second difference data.

7. A musical tone generating apparatus according to claim 6, wherein said third data reproducing means further comprises a plurality of circuit means connected in series and each having the same construction as said third data reproducing means.

8. A musical tone generating apparatus according to claim 1, wherein said each prediction data is obtained by effecting said first linear operation on those of said series of sample data produced before and after said each sample data, said those of said sample data including at least three of said series of sample data.

9. A musical tone generating apparatus according to claim 6, wherein said prediction data is obtained through:

a plurality of stages of a third delay circuit means whose first stage is supplied with said each sample data, each of said stages delaying an input thereto by a third time interval corresponding to said sampling interval to produce a delay output;

a plurality of second multiplier means each multiplying said delayed output from a respective one of said stages by a predetermined coefficient chosen in accordance with said first and second linear operations to output a multiplication result; and third adder means for adding all multiplication results of said plurality of second multiplier means together to form said prediction data.

10. A musical tone generating apparatus according to claim 9, wherein said data reproducing means comprises:

fourth adder means;

a plurality of stages of fourth delay circuit means equal in number of stages to said third delay circuit means, the first stage of said fourth delay circuit means being supplied with an output of said fourth adder means, each of said stages delaying an input thereto by said third time interval to produce a delayed output;

a plurality of third multiplier means each multiplying said delayed output from a respective one of said stages of said fourth delay circuit means by a predetermined coefficient chosen in accordance with said first and second linear operations to output a multiplication result; and fifth adder means adding all multiplication results of said plurality of third multiplier means together to output an additional result;

said fourth adder means adding said addition result to said each outputted difference data to form said corresponding one of said sample data.

11. A musical tone generating apparatus according to claim 8, wherein said prediction data is obtained through:

a plurality of stages of a fifth delay circuit means whose first stage is supplied with said each sample data, each of said stages delaying an input thereto by a fourth time interval corresponding to a predetermined number of periods of said tone signal to produce a delayed output;

a plurality of fourth multiplier means each multiplying said delayed output from a respective one of said stages by a predetermined coefficient chosen in accordance with said first and second linear operations to output a multiplication result; and sixth adder means for adding all multiplication results of said plurality of fourth multiplier means together to form said prediction data.

12. A musical tone generating apparatus according to claim 11, wherein said data reproducing means comprises:

seventh adder means;

a plurality of stages of a sixth delay circuit means equal in number of stages to said fifth delay circuit means, the first stage of said sixth delay circuit means being supplied with an output of said seventh adder means, each of said stages delaying an input thereto by said fourth time interval to produce a delayed output;

a plurality of fifth multiplier means each multiplying said delaying output from a respective one of said stages of said sixth delay circuit by a predetermined coefficient chosen in accordance with said first and second linear operations to output a multiplication result; and eighth adder means adding all multiplication results of said plurality of fifth multiplier means together to output an additional result;

said seventh adder means adding said addition result from said eighth adder means to said outputted difference data to form said corresponding one of said sample data.

13. A musical tone data compression apparatus for a musical tone generating apparatus of an electronic musical instrument comprising:

sampling means for sampling plural amplitude values at plural points in time from a musical tone signal to be produced; and prediction means for calculating other amplitude values at said plural points by effecting a linear operation on a subset of said plurality of sampled amplitude values, each of said other amplitude values being determined on the basis of one or more points before and after a point in time corresponding to a sampled amplitude value outside the subset of said plural amplitude values.

14. A musical tone data compression apparatus according to claim 13 further comprising first subtracting means which subtracts said other amplitude values from said amplitude values and outputs a first subtracted result.

15. A musical tone data compression apparatus according to claim 14 further comprising:

delay means for delaying said first subtracted result by a period; and second subtracting means which subtracts said delayed first subtracted result from said first subtracted result and outputs a second subtracted result.

16. A musical tone generating apparatus for an electronic musical instrument comprising:

memory means for storing difference data corresponding to the difference between musical tone data representing amplitude values of a musical tone signal to be generated and prediction data calculated by effecting a first linear operation on said musical tone data; and reproducing means for reproducing said musical tone data, said reproducing means comprising second operation means which calculates said prediction data by effecting a second linear operation, and adding means which adds said prediction data to data corresponding to said difference data and outputs the added result, said musical tone data being said added result.

17. A musical tone generating apparatus according to claim 16, wherein said musical tone signal has a plurality of periods, and said difference data represents a difference between a first tone data-prediction data difference corresponding to a first period and a second tone data-prediction data difference corresponding to a second period, and said reproducing means further comprises delay means which delays said difference data by a period and adding means which adds said delayed difference data to said difference data and outputs the added result as said corresponding data.

18. A data compression device for reducing the amount of memory space needed to store data representing sampled points of a musical tone, comprising:

prediction means for receiving a set of sample point values and calculating, from a subset of the received set of sample point values, a predicted value of one sample point whose actual value is a member of the sample set but not of the subset; and difference generating means, coupled to the prediction means, for generating difference information representing the difference between the predicted value and the actual value of the one sample point.

19. The data compression device of claim 18 wherein the prediction means includes means for linearly calculating the predicted value from the subset.

20. A musical tone reproducing device for reproducing the amplitude values of sampled points of a musical tone, comprising:

memory means for storing difference information representing the difference between the actual amplitude value of one sample point and a predicted amplitude value for that sample point, the predicted amplitude value being one derived from the actual amplitude values of other sample points using a preselected predicting function; and data reconstructing means, coupled to the memory means, for generating actual data representing the actual amplitude value of the one sample point by adding the predicted value, which is derived using the preselected predicting function, to the difference information stored in the memory means.

* * * * *